US007085526B2

(12) United States Patent
Tanimoto

(10) Patent No.: US 7,085,526 B2
(45) Date of Patent: Aug. 1, 2006

(54) IMAGE FORMING METHOD AND IMAGE FORMING APPARATUS

(75) Inventor: Takeshi Tanimoto, Sagamihara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/484,964

(22) PCT Filed: Jul. 30, 2001

(86) PCT No.: PCT/JP01/06567

§ 371 (c)(1),
(2), (4) Date: Jan. 28, 2004

(87) PCT Pub. No.: WO03/012554

PCT Pub. Date: Feb. 13, 2003

(65) Prior Publication Data

US 2004/0190952 A1 Sep. 30, 2004

(51) Int. Cl.
*G03G 15/16* (2006.01)
*G03G 15/00* (2006.01)

(52) U.S. Cl. ..... 399/313; 399/384

(58) Field of Classification Search ..... 399/66, 399/310, 313, 316, 318, 384, 317
See application file for complete search history.

(56) References Cited

U.S. PATENT DOCUMENTS 4,431,301 A * 2/1984 Hashimoto et al. ..... 399/313 X
4,478,508 A * 10/1984 Kato et al. ..... 399/384
4,998,143 A * 3/1991 Kumasaka et al. ..... 399/101
5,063,416 A * 11/1991 Honda et al. ..... 399/384
5,179,417 A * 1/1993 Sugaya et al. ..... 399/361
5,481,352 A * 1/1996 Yamamoto et al. ..... 399/384
5,515,149 A * 5/1996 Ishikawa et al. ..... 399/384
5,729,788 A * 3/1998 Hirohashi et al. ..... 399/66
6,167,215 A * 12/2000 Miyashiro et al. ..... 399/66
6,188,862 B1 * 2/2001 Ishii ..... 399/313
6,370,351 B1 * 4/2002 Puritscher et al. ..... 399/313

FOREIGN PATENT DOCUMENTS

JP 50-034543 * 4/1975
JP 53-017343 * 2/1978
JP 02-082278 * 3/1990

OTHER PUBLICATIONS

JPO Nov. 8, 2005 Office Action and English translation thereof from co-pending Patent Application No. JP2003-A-517677.

* cited by examiner

*Primary Examiner*—Sandra L. Brase
(74) *Attorney, Agent, or Firm*—Oliff & Berridge, PLC

(57) ABSTRACT

An apparatus and a method for forming an image is provided that uses a contact type transfer member and a retract mechanism so as to transfer a toner image onto a continuous medium, performs the transfer process stably onto various continuous media and reduces unnecessary transfer of toner from the contact type transfer member to the continuous medium.

The unnecessary transfer of toner may be caused by a concentration of contact stress when the contact type transfer member (16), which is moved by a retract mechanism, contacts with the continuous medium (25). To dissipate the contact stress, the transfer member (16) contacts with the continuous medium (25) while the continuous medium (25) is steadily conveyed and the transfer member is steadily rotated. Accordingly, the transfer of the toner from the transfer member (16) to the continuous medium (25) may be reduced. Furthermore, the friction at the contact line may be reduced and thus staining of the continuous medium may be further reduced.

22 Claims, 24 Drawing Sheets

FIG. 26

| VELOCITY DIFFERENCES BETWEEN TRANSFER MEMBER AND PAPER | STAINED STATE OF BACKSIDE OF THE PAPER |
|---|---|
| +8% | X STAINED |
| +7% | X STAINED |
| +6% | △ FAINTLY STAINED |
| +5%～-5% | ○ NOT STAINED |
| -6% | △ FAINTLY STAINED |
| -7% | X STAINED |
| -8% | X STAINED |

| VELOCITY DIFFERENCE BETWEEN DRUM ROTATION AND TRANSFER MEMBER (OR SHEET) MOVEMENT | STATE OF BACKSIDE OF THE PAPER INCLUDING STAIN |
|---|---|
| +8% | X STAINED, WRINKLE ON PAPER |
| +7% | X STAINED, WRINKLE ON PAPER |
| +6% | △ FAINTLY STAINED |
| +5%～-5% | ○ NOT STAINED |
| -6% | △ FAINTLY STAINED |
| -7% | X STAINED, WRINKLE ON PAPER |
| -8% | X STAINED, WRINKLE ON PAPER |

FIG. 31 [PRIOR ART]
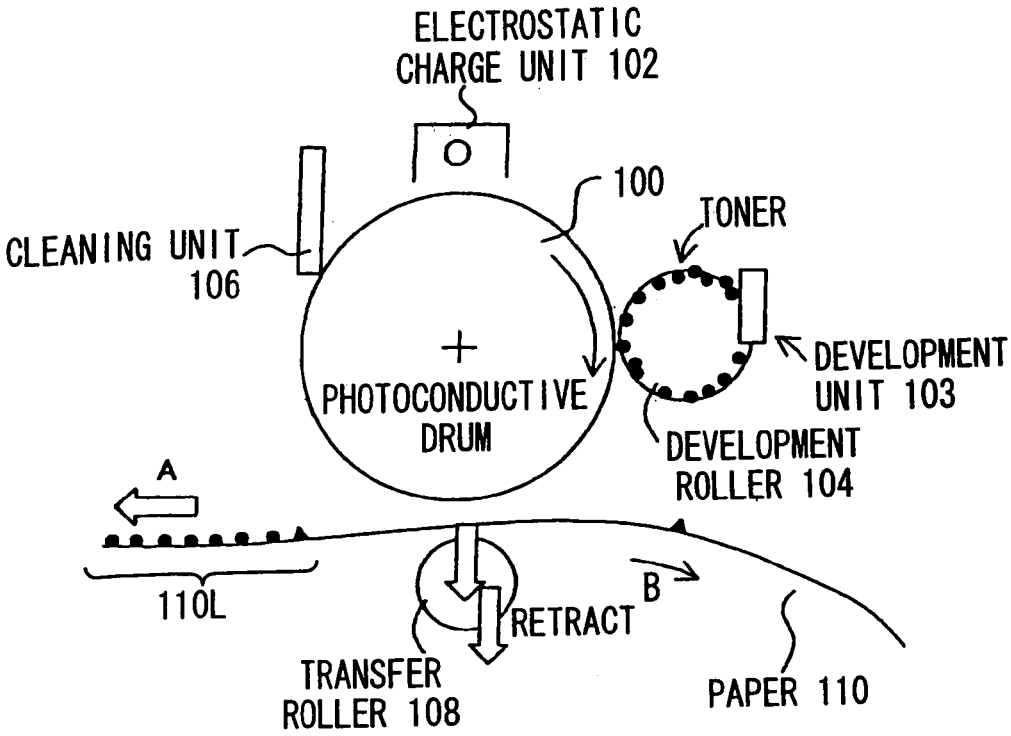
FIG. 32 [PRIOR ART]
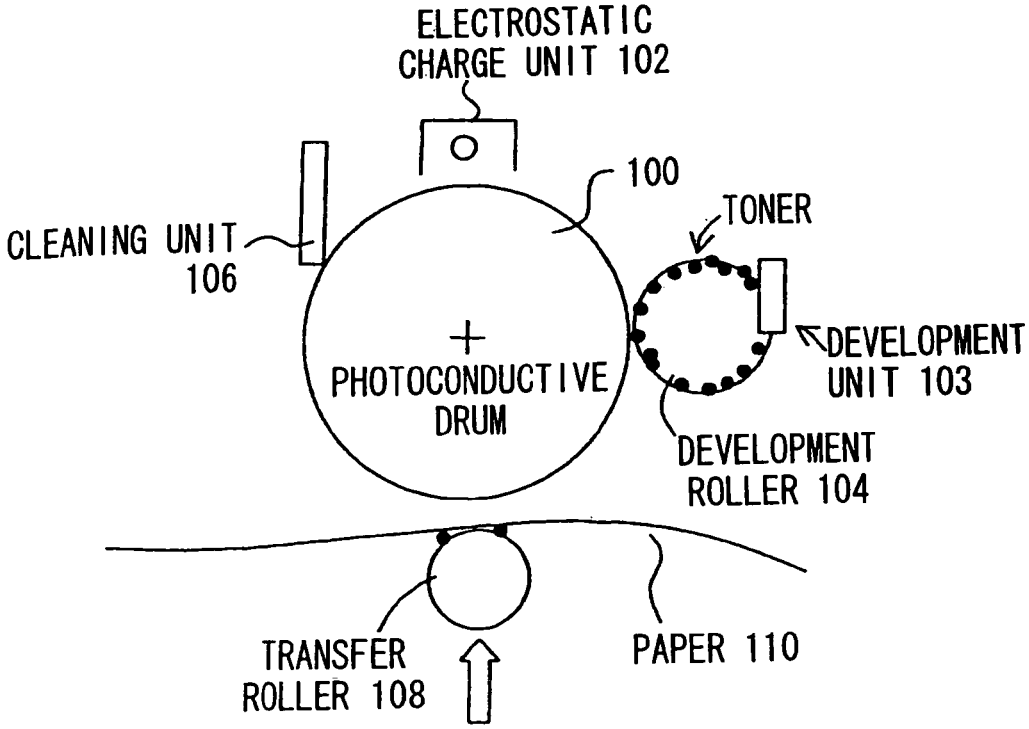

IMAGE FORMING METHOD AND IMAGE FORMING APPARATUS

TECHNICAL FIELD

The present invention relates to a method and an apparatus for forming an image by use of an electro-photographic process on a continuous medium such as a continuous paper, during a conveying motion of the continuous medium. In particular, the present invention relates to a method and an apparatus for forming an image, in which a contact type transfer unit is employed to transfer a toner image.

PRIOR ART

Apparatuses for forming images by use of an electro-photographic process are widely used in devices such as printers, photocopiers, and facsimiles. In such apparatuses for forming images, a toner image is formed on an image support member such as a photoconductive drum, and then transferred onto a paper. Thus, an image is formed on the paper.

Methods for transferring the toner image include a non-contact type transfer method using an electrostatic charge unit such as a corona charge unit, a contact type transfer method using a transfer roller or the like. In most printers using a cut-sheet paper as a print medium, the contact type transfer method using a transfer roller is employed. In most printers using a continuous paper as a print medium, the non-contact type transferring method using a corona charge unit is employed.

Previously, a continuous paper having specified minimum levels of quality and thickness has been used in printers which use a continuous paper as a print medium. However, there is a demand for printers which can use a continuous paper of lower quality, with a thin form, or with a light weight, in the same way as in the case of cut-sheet paper. Accordingly, printers using a continuous paper need to support various types of paper.

To transfer the toner image reliably onto various papers, a paper is required to tight and uniformly contact with a photoconductive drum in a transfer section of the drum. In a transfer operation using a corona-type transfer unit, the paper tightly contacts with the photoconductive drum in the transfer section because of tensile force of the paper and electrostatic attractive force. In a transfer operation using a transfer roller, a tight mechanical contact force is added in the transfer section, since the paper is pinched between the transfer roller and the photoconductive drum. Accordingly, a study of the possibility of employing a transfer method using a transfer roller is conducted in the printers using a continuous paper.

A printer using a continuous paper performs a different print operation from that of a printer using a cut-sheet paper. In a printer using a cut-sheet paper, a medium is pre-separated sheet by sheet in the size of A4, B4 or the like. The medium is then supplied to the transfer section. Therefore, transfer operations may easily be separated in the operational unit of a printer using a cut-sheet paper. On the contrary, in a printer using continuous paper a paper is in the form of a single continuous paper which goes from a hopper through a transfer section to a stacker. Accordingly, the paper remains in the transfer section after a specified number of pages are printed.

Furthermore, an electro-photographic process requires a fusing process of the toner image after the transfer process. Therefore, in the above print operation using a continuous paper, the last printed page in the previous print operation is conveyed from the transfer section to a fusing section before the conveying motion of the continuous paper is stopped and the toner image on the last page is fused. Since the transfer section and the fusing section may not be disposed closely side by side, the sections are disposed at a specific distance from each other. Accordingly, at commencement of the next print operation, if the continuous paper has stopped its movement at a position where the last page of the previous operation is in the fusing section, a blank region is provided on the continuous paper, the region corresponding to the specific distance between both sections. This leads to paper being wasted.

To avoid the wasted region of paper, the start position of the next print job is set at the page subsequent to the last printed page of the previous print job. To this end, the printer using a continuous paper feeds the continuous paper backward. Namely, the printer conveys the continuous paper in the direction indicated by the arrow A during a print operation. Then, as shown in FIG. 31, the printer conveys the continuous paper in the backward direction indicated by the arrow B, so that the front end of the page subsequent to the last printed page 110-L of the previous print job is situated in the transfer section between the photoconductive drum 100 and the transfer roller 108.

The transfer operation is not performed while the continuous paper is feeding backward. Therefore, if the continuous paper 110 is pinched between the transfer roller 108 and the photoconductive drum 100, images on the continuous paper 110 may be distorted by the photoconductive drum 100 and/or the transfer roller 108. The continuous paper 110 may be also stained. Furthermore, the transfer roller 108 hinders the feeding of the continuous paper 110 backward. The photoconductive drum 100 needs to be rotated backward. Therefore, it becomes difficult to feed the continuous paper backward. To overcome this problem, the transfer roller 108 is retracted, so that the photoconductive drum 100 and the transfer roller 108 are apart from the continuous paper 110. Then the continuous paper may be smoothly fed backward.

As shown in FIG. 32, when the next print job is started in this condition, the transfer roller 108 is pushed onto the photoconductive drum 100. Namely, the transfer roller 108 is pushed onto the photoconductive drum 100 so as to transfer the toner image, which is formed on the photoconductive drum 100 with the electrostatic charge unit 102 and the development unit 103 (the development roller 104).

In the prior art, the transfer roller 108 stops its rotation and the continuous paper 110 is not conveyed in this condition. The mechanical contact force between the transfer roller 108 and the continuous paper 110 is large when the transfer roller 108 contacts the continuous paper 110. Therefore, toner which adheres to the transfer roller 108 tends to transfer onto the continuous paper 110. This transfer causes stains on the back side of the continuous paper and adversely affects the print quality. In the case of both side printing, the print face may be stained and this also adversely affects the print quality.

Since the transfer roller 108 is generally configured as an elastic material, toner tends to adhere to the surface of the transfer roller 108. In a printer using a continuous paper, for example, the following process may cause toner to adhere to the surface of the photoconductive drum 100. In a print operation on a continuous paper having a narrow width, toner may remain on the side marginal regions of the photoconductive drum 100 beyond the width of the narrow paper. The toner remained on the marginal regions may be transferred to the transfer roller 108. Then, the toner may be transferred from the transfer roller 108 onto the wider continuous paper, while printing on a wider continuous paper.

The transfer of the toner is caused by the impact force when the transfer roller 108 is pushed from its retracted position onto the photoconductive drum 100. Therefore, the transfer roller 108 may be made from a soft material to reduce the transfer of toner. Nevertheless, since the transfer roller 108 made of a soft material has a shorter life span, the lifetime of the apparatus is shortened when a soft material is employed in the contact type transfer mechanism.

SUMMARY OF THE INVENTION

Accordingly, the present invention provides a method and an apparatus for forming an image that may avoid stains on the back side of the continuous medium while employing a contact type transfer unit for transferring onto the continuous medium.

The present invention also provides a method and an apparatus for forming an image that may reduce the impact force when the contact type transfer unit contacts the continuous medium to transfer onto the continuous medium, and that may prevent transferring toner from the contact type transfer unit to the continuous medium.

The present invention also provides a method and an apparatus for forming an image that may reduce the impact force when the contact type transfer unit contacts the continuous medium, and that may avoid transferring toner from the contact type transfer unit to the continuous medium, while a relatively hard material is employed in the contact type transfer unit.

To accomplish the above objectives, the method for forming an image according to the present invention includes a step of forming a toner image on an image support member which is rotating; a step of conveying the continuous medium; a step of rotating a contact type transfer member which is in a retracted position; a step of bringing the contact type transfer member into contact with the image support member; a step of transferring the toner image, which is formed on the image support member, onto the continuous medium by use of the contact type transfer member; and a step of retracting the contact type transfer member from the image support member, when the step of transferring is finished.

The apparatus for forming an image according to the present invention, includes a mechanism that forms a toner image on an image support member which is rotating; a conveyor that conveys the continuous medium; a contact type transfer member that transfers the toner image, which is formed on the image support member, onto the continuous medium; a rotation device that rotates the contact type transfer member; a transfer member retract mechanism that retracts the contact type transfer member from the image support member; and a controller that causes the contact type transfer member to rotate at the start of the print process, and then brings the contact type transfer member into contact with the image support member via the continuous medium, and transfers the toner image formed on the image support member onto the continuous medium, and causes the contact type transfer member to retract from the image support member at the end of the print process using the transfer process.

According to the present invention, a toner image is transferred onto a continuous medium using the contact type transfer member and the retract mechanism. The transfer process may be stably performed onto various continuous media. Unnecessary transfer of toner from the contact type transfer member to the continuous medium may be reduced. The cause of unnecessary transfer of toner is a concentration of contact stress when the contact type transfer member, which is moved by a retract mechanism, contacts the continuous medium. According to the present invention, the contact type transfer member contacts the continuous medium while the continuous medium is steadily conveyed and the transfer member is steadily rotated so as to dissipate the contact stress. Accordingly, the transfer of toner from the transfer member to the continuous medium may be reduced. Furthermore, friction at the point of contact may be reduced, and thus stains on the continuous medium may be further reduced.

According to the present invention, the method preferably includes a step of feeding the continuous medium backward after the retracting step. Accordingly, a [next] print operation may be started immediately after the last printed region, even if a retractable transfer member is used for transferring a toner image onto the continuous medium. It is thereby possible to avoid producing an unnecessary blank region on the continuous medium.

According to the present invention, the transferring step preferably includes a step of applying a transfer bias voltage on the contact type transfer member after the contact type transfer member contacts the image support member, thereby facilitating the transfer. After the contact, conveying of the continuous medium may start before the transfer bias voltage is applied. Accordingly, an unnecessary discharge may be avoided.

According to the present invention, the step of bringing the contact type transfer member into contact with the image support member preferably includes a step of moving a transfer guide member, that guides the movement of the continuous medium, and the contact type transfer member toward the image support member. Accordingly, movement of the transfer guide member movies facilitated. Then the transfer member may easily make contact while rotating.

According to the present invention, the conveying step preferably includes a step of conveying a zigzag folded paper with perforated lines as a continuous medium. According to the present invention, the conveyor is preferably configured as a tractor feed mechanism that conveys the zigzag folded paper using the tractor wheel engaging with sprocket holes of the zigzag folded medium. Two of the tractor feed mechanisms are preferably disposed at both ends of the contact type transfer member. More preferably, the contact type transfer member is configured as a transfer roller.

BRIEF DESCRIPTION OF THE DRAWINGS

FIG. 26 shows in detail the experimental example of the velocity differences among the photoconductive drum, the continuous paper, and the transfer roller in the configuration shown in FIG. 3.

FIG. 31 shows in detail the transfer mechanism in the image forming apparatus of the prior art.

FIG. 32 shows in detail the contact operation in the transfer mechanism of the prior art.

PREFERRED EMBODIMENTS

The embodiments of the present invention will be described below in the order of image forming apparatus, print control method and other embodiments.

[Image Forming Apparatus]

Figure 1:
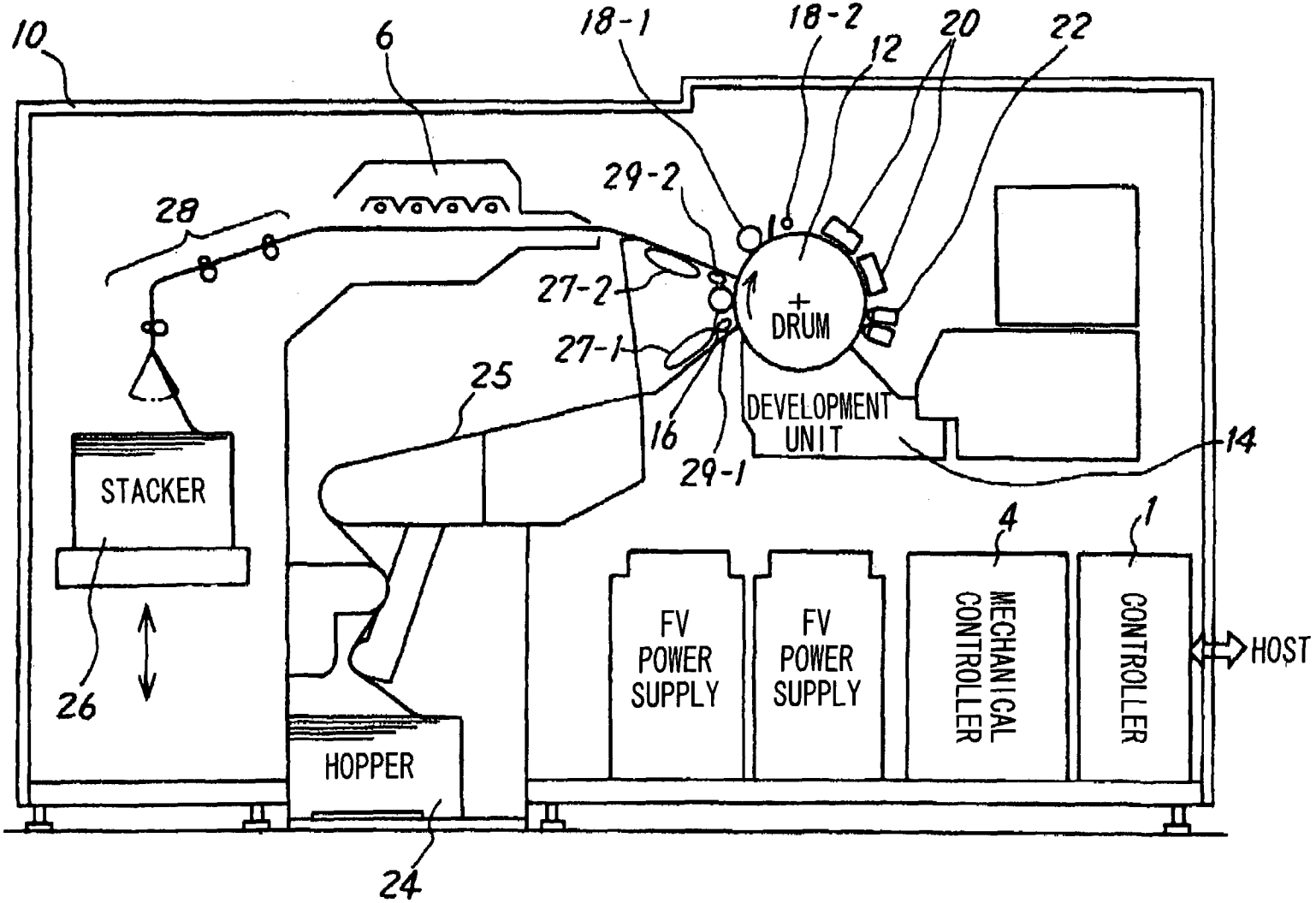
FIG. 1 shows a general configuration of an apparatus for forming an image in an embodiment according to the present invention.
Figure 2:
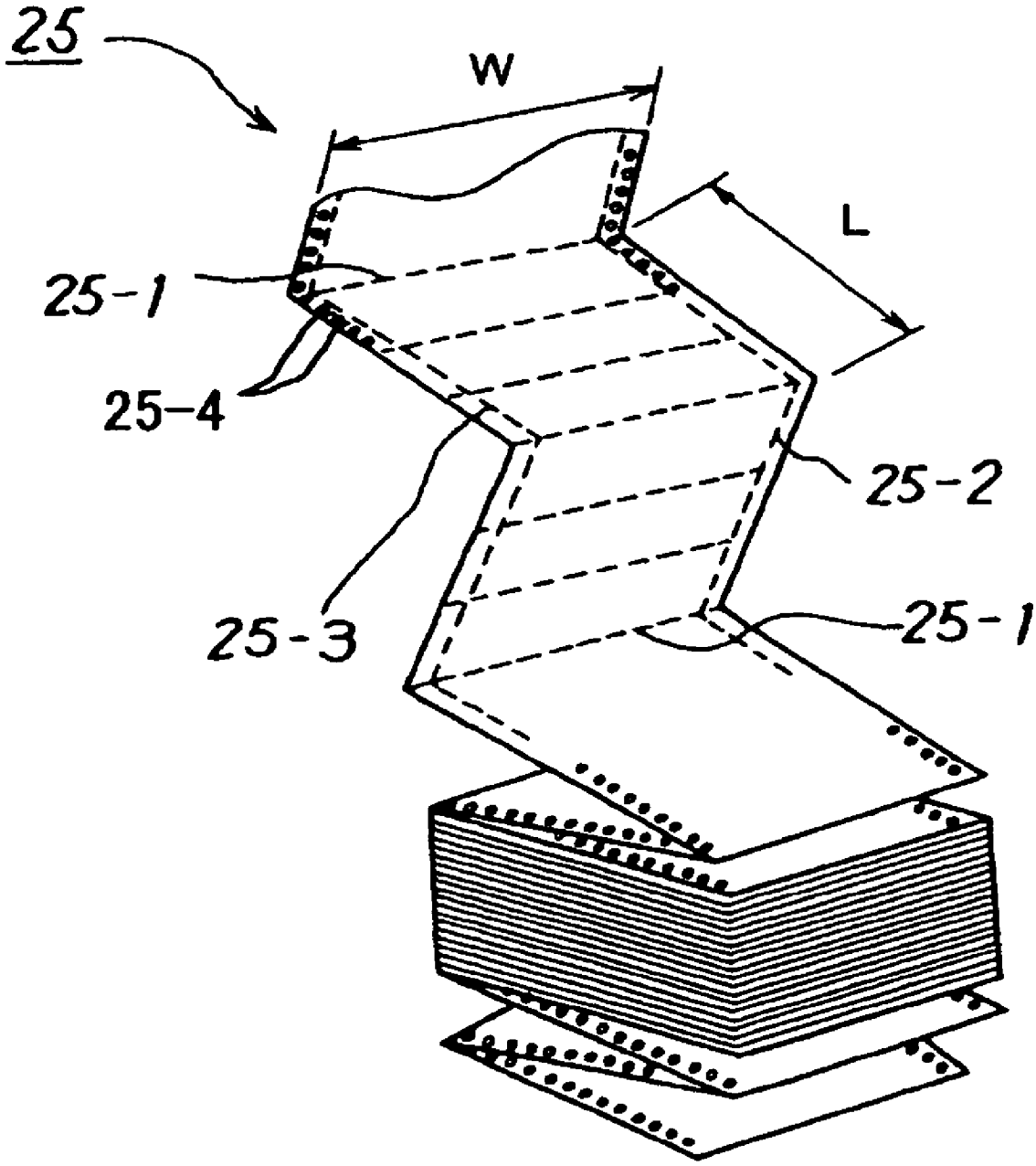
FIG. 2 shows in detail the continuous medium shown in FIG. 1.
Figure 3:
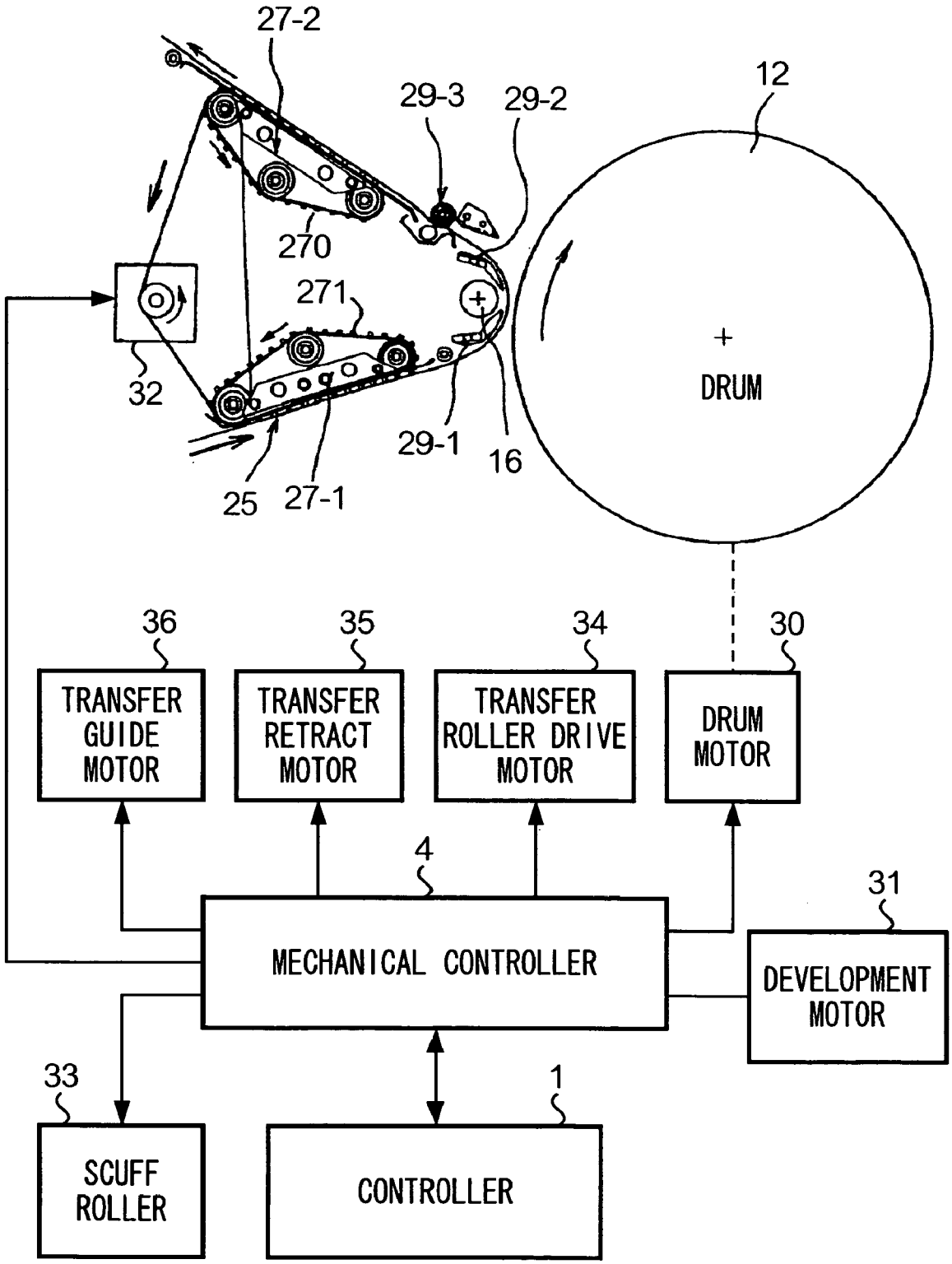
FIG. 3 shows a block diagram showing the drive mechanism of the configuration shown in FIG. 1.

FIG. 1 shows the total configuration diagram of the image forming apparatus according to an embodiment of the present invention. FIG. 2 shows in detail a continuous medium shown in FIG. 1. FIG. 3 is a block diagram showing in detail a drive mechanism shown in FIG. 1.

FIG. 1 shows, as an example of the image forming apparatus, a continuous paper page printer using an electro-photographic system. As shown in FIG. 1, the printer body 10 is configured as an electro-photographic mechanism. The photoconductive drum 12 rotates in the direction of the arrow shown in FIG. 1. The photoconductive drum 12 is electro-statically charged by the electrostatic charge unit 20. Then the photoconductive drum 12 is exposed to form an image using the Light Emitting Diode (LED) head 22. Accordingly, a latent image is formed on the photoconductive drum 12. The development unit 14 supplies the photoconductive drum 12 with a 2-component development agent, and converts the latent image on the photoconductive drum 12 into a toner image.

The transfer unit 16 includes a transfer roller, that is, a contact type transfer unit. The transfer unit transfers the toner image onto the sheet 25. The transfer guide members 29-1 and 29-2 are disposed above and below the transfer roller 16, respectively. The transfer guide members 29-1 and 29-2 assist the sheet 25 to contact tightly with the photoconductive drum 12 in the transfer region. The cleaning mechanism 18-1 removes toner residues from the photoconductive drum 12, after the toner is transferred. The charge eliminate mechanism 18-2 eliminates charges on the photoconductive drum 12, after the toner is transferred.

As shown in FIG. 2 the sheet 25 is in a form of continuous paper, each page being provided with perforated lines 25-1 (either perforated lines for zigzag folding or perforated lines for paging). The continuous paper 25 has sprocket holes 25-4 in its left and right marginal regions. To facilitate the separation of both marginal regions from the continuous paper, the left and right perforated lines 25-2 and 25-3 are provided along the border of each marginal region.

The continuous paper 25 is loaded in the hopper 24. The sheet 25 in the hopper 24 is conveyed by the lower tractor feeder 27-1 to the transfer position. Then the sheet 25 is conveyed by the upper tractor feeder 27-2 to the flash fusing unit 6. The continuous paper 25 is further conveyed by the scuff roller 28 and then stored in the stacker 26. The flash fusing unit 6 fuses the toner image on the sheet 25 by firing the flash light.

The printer 10 is ready for high speed printing. For example, the printer 10 may print over 100 sheets per minute. The printer 10 includes the printer controller 1 and the mechanical controller 4. The printer controller 1 interprets commands sent from the host (not shown) and generates internal commands and print data (bit-mapped data). The print data are expanded in the bit mapped memory.

The mechanical controller 4 controls, in response to the internal commands, each of the components 12, 14, 16, 18-2, 20, and 22 in the electro-photographic mechanism, and each of the components 27-1, 27-2 and 28 in the convey mechanism, as described later, referring to FIG. 3. The print start process and the print finish process in the mechanical controller 4 will be described later, referring to FIGS. 10 to 12.

As shown in FIG. 3, the lower and upper tractor feeders 27-1 and 27-2 have the tractor belts 270 and 271, respectively. The tractor belts 270 and 271 have protrusions for engaging with the sprocket holes 25-4 of the continuous paper 25. The tractor belts are driven by the convey motor 32. The transfer roller 16 is driven to rotate by the transfer roller drive motor 34. The retract motor 35 in the transfer roller retract mechanism performs the retracting operation of the transfer roller 16 from the photoconductive drum 12.

The transfer guide motor 36 in the transfer guide mechanism performs the guide operation of the transfer guide members 29-1 and 29-2, which are provided above and below the transfer roller 16, respectively. The scuff motor 33 drives the scuff roller 28 shown in FIG. 1. The drum motor 30 rotates the photoconductive roller 12. The development motor 31 drives the development roller and the like in the development unit 14 shown in FIG. 1.

The mechanical controller 4 performs the print start process (FIG. 10) and the print finish process (FIG. 11) in response to print commands from the controller 1. The mechanical controller 4 controls the rotations of each one of the motors 30, 31, 33, 34, 35, and 36 and controls the bias voltages applied to the electrostatic charge unit 20, the expose unit 22, the charge eliminate unit 18-2 and other kinds of bias voltages.

The controller 1 and the mechanical controller 4 include a central processor and a memory unit. The pinch roller 29-3 is disposed between the upper tractor feeder 27-2 and the transfer guide member 29-2. The pinch roller 29-3 presses the continuous paper 25 and guides the continuous paper 25 to the upper tractor 27-2. FIG. 3 shows the transfer roller 16 in the retracted state.

The drive mechanism and the retract mechanism of the transfer roller 16 shown in FIG. 3 will be described referring to FIGS. 4 to 6. The transfer guide mechanism shown in FIG. 3 will be described referring to FIGS. 7 and 8.

Figure 4:
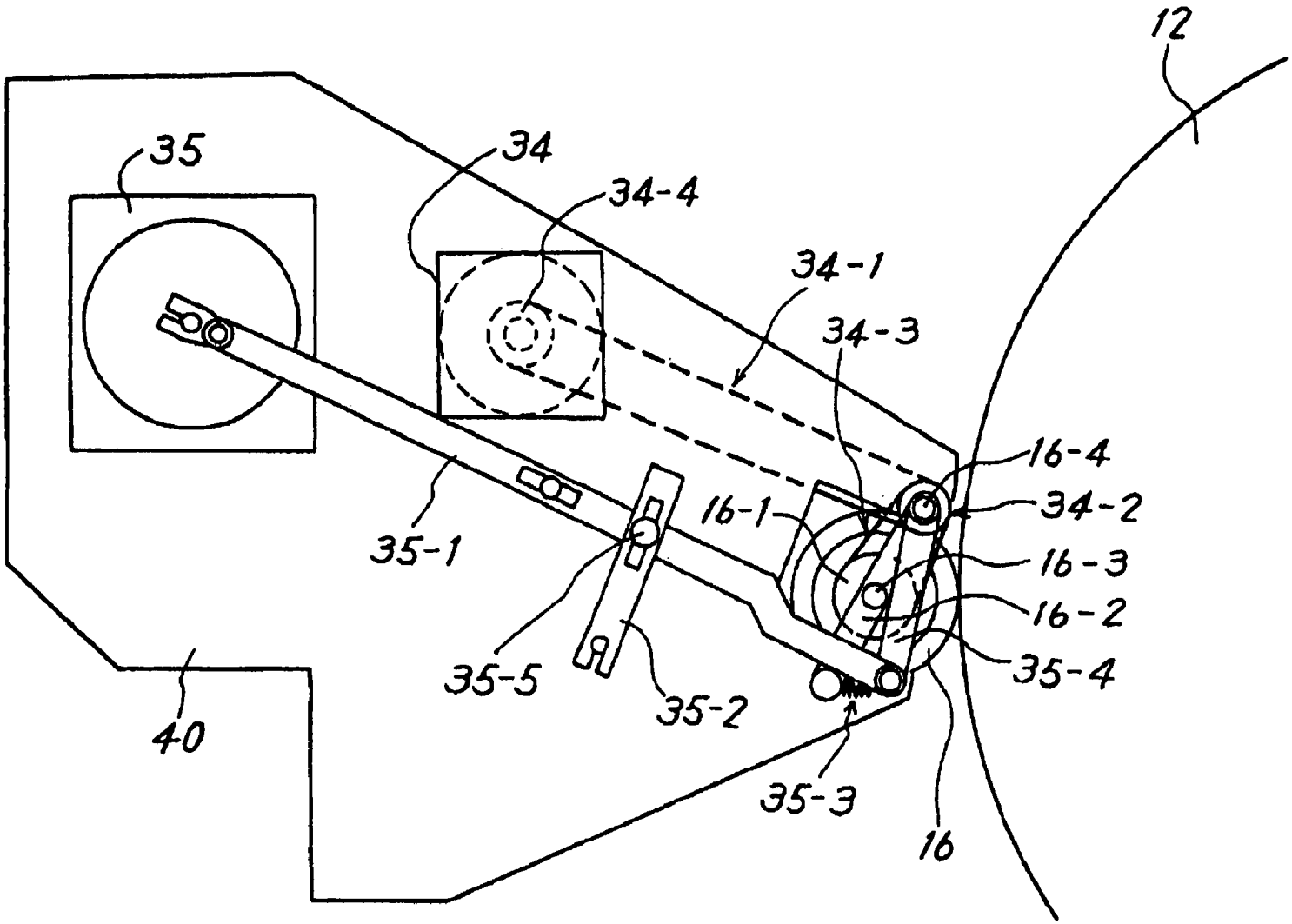
FIG. 4 shows a cross sectional view of the transfer roller drive mechanism and the transfer roller retract mechanism in the configuration shown in FIG. 3.
Figure 5:
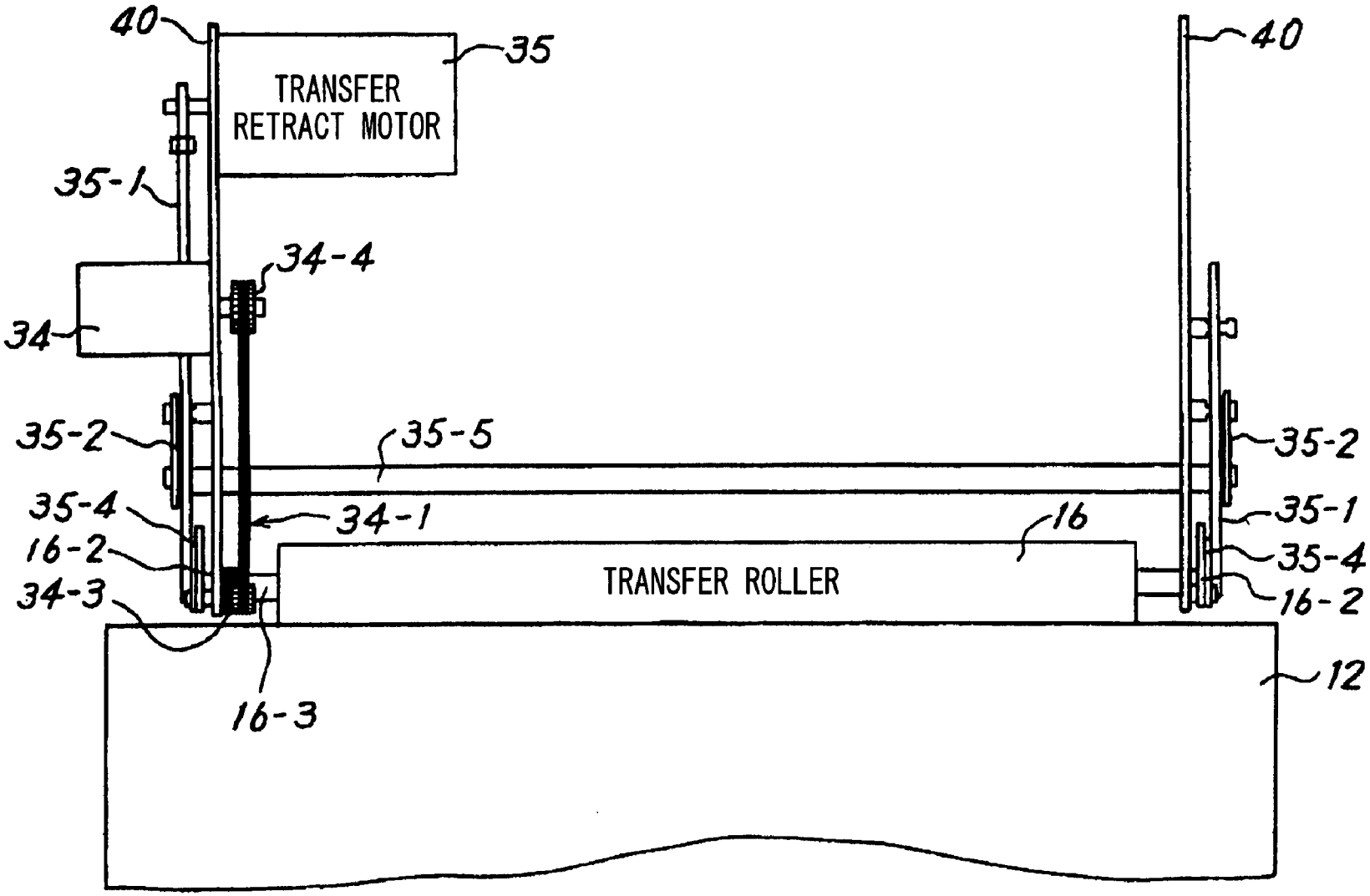
FIG. 5 shows a front view of the transfer roller drive mechanism and the transfer roller retract mechanism shown in FIG. 4.

As shown in FIGS. 4 and 5, the transfer roller drive motor 34 and the transfer retract motor 35 are attached to one of a pair of the side walls 40. Between the pair of the side walls 40, the transfer roller 16 and the link bar 35-5 are disposed. The pulley wheel 16-1 is disposed at the rotation axis 16-3 of the transfer roller 16, and the pulley wheel 16-1 is supported by one end of the rotation arm 16-2. Another end of the rotation arm 16-2 is rotatably mounted on the rotation support axis 16-4 which is provided on the side wall 40.

The pulley 34-4 is disposed on the rotation axis of the transfer roller drive motor 34. The pulley 34-2 is disposed on the rotation support axis 16-4 provided on the side wall 40. The convey belt 34-1 is disposed between both the pulley 34-4 and the pulley 34-2. The pulley 34-2 is coupled to the pulley 16-1 of on the transfer roller 16 with the convey belt 34-3. Thus, the transfer roller 16 rotates when the drive motor 34 brings the convey belts 34-1 and 34-3 into rotation.

The drive lever 35-1, that engages the rotation axis, is disposed on the rotation axis of the retract motor 35. The link bar 35-5 is disposed on the drive lever 35-1. The link lever 35-5 is supported on the support lever 35-2 which is rotatable. The end of the drive lever 35-1 is connected to the lower end of the arm 35-4 that is provided rotatably on the rotation support axis 16-4. The lower end of the arm 35-4 and the lower end of the rotation arm 16-2 are connected via the spring 35-3.

Figure 6:
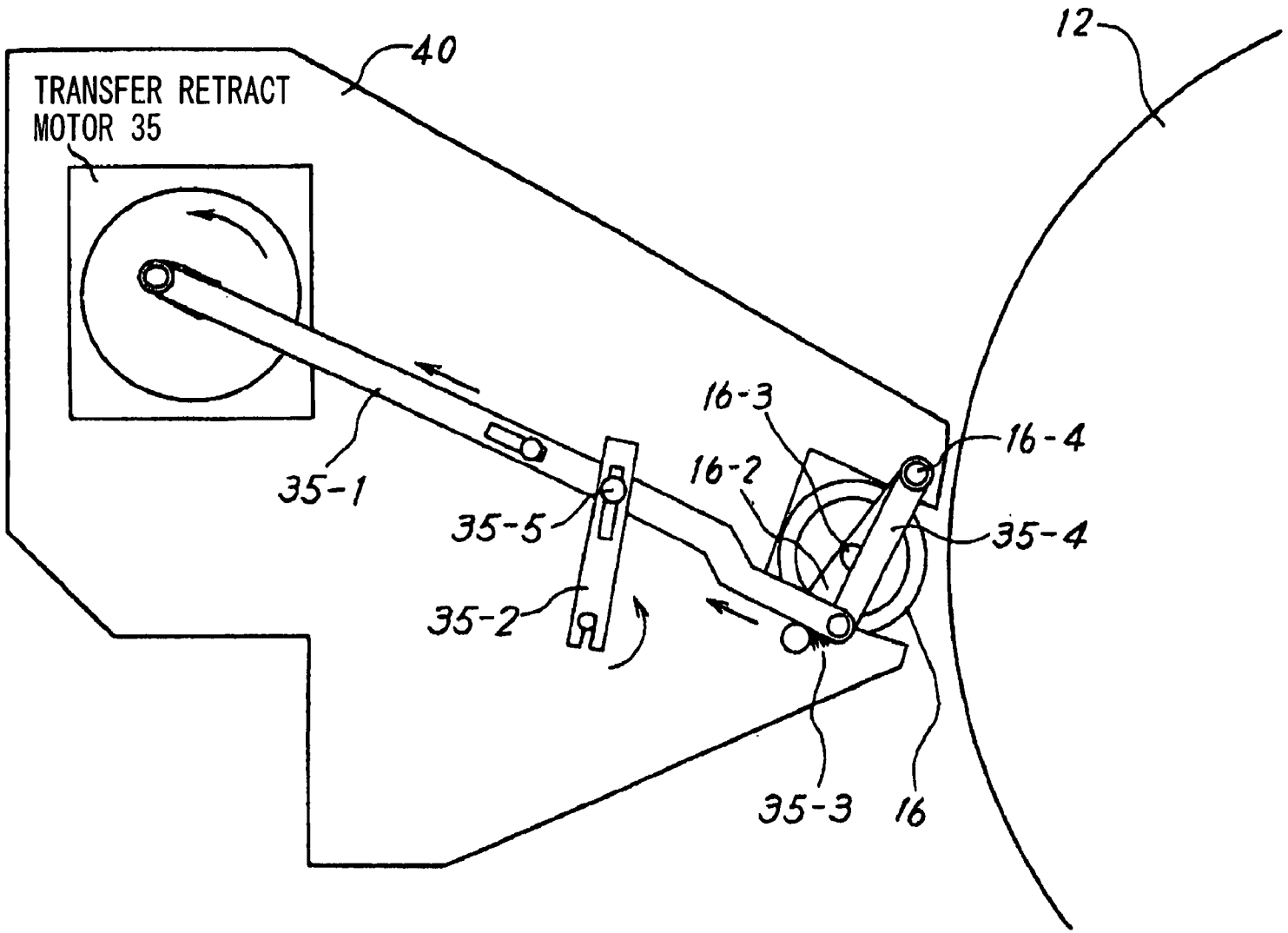
FIG. 6 shows in detail the operation of the transfer roller retract mechanism shown in FIG. 4.

Accordingly, in the contacting state shown in FIG. 4, the drive lever 35-1 moves in the direction of the arrow and drives the arm 35-4 to rotate clockwise around the rotation support axis 16-4, when the transfer retract motor rotates in the direction of the arrow shown in FIG. 6. Accordingly, the rotation arm 16-2 also rotates clockwise around the rotation support axis 16-4 with the help of the spring 35-3. Then the transfer roller 16 separates from the photoconductive drum 12.

Conversely, in the retracted state shown in FIG. 6, the drive lever 35-1 moves and the arm 35-4 rotates counter-clockwise around the rotation support axis 16-4 as shown in FIG. 4, when the retract motor further rotates in the direction shown in FIG. 6. Accordingly, the rotation arm 16-2 also rotates counter-clockwise around the rotation support axis 16-4 with the help of the spring 35-3. Then the transfer roller 16 contacts with the photoconductive drum 12.

In the embodiment, the arm 35-4 and the rotation arm 16-2 are connected via the spring 35-3. Therefore, the transfer roller 16 may contact with the photoconductive drum at a constant pressure in the contact state. Namely, the contact pressure may vary according to the deviation in thickness of the continuous paper 25 or the eccentricity of the photoconductive drum 12, so that the contact pressure may be maintained uniformly.

Figure 7:
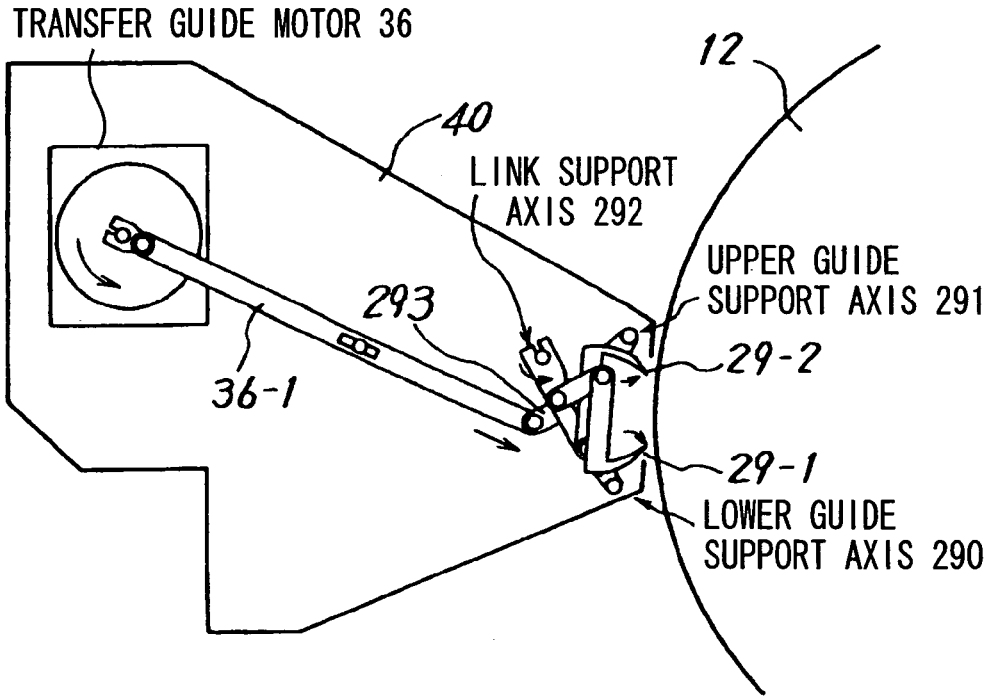
FIG. 7 shows a cross sectional view of the transfer roller guide mechanism in the configuration shown in FIG. 3.
Figure 8:
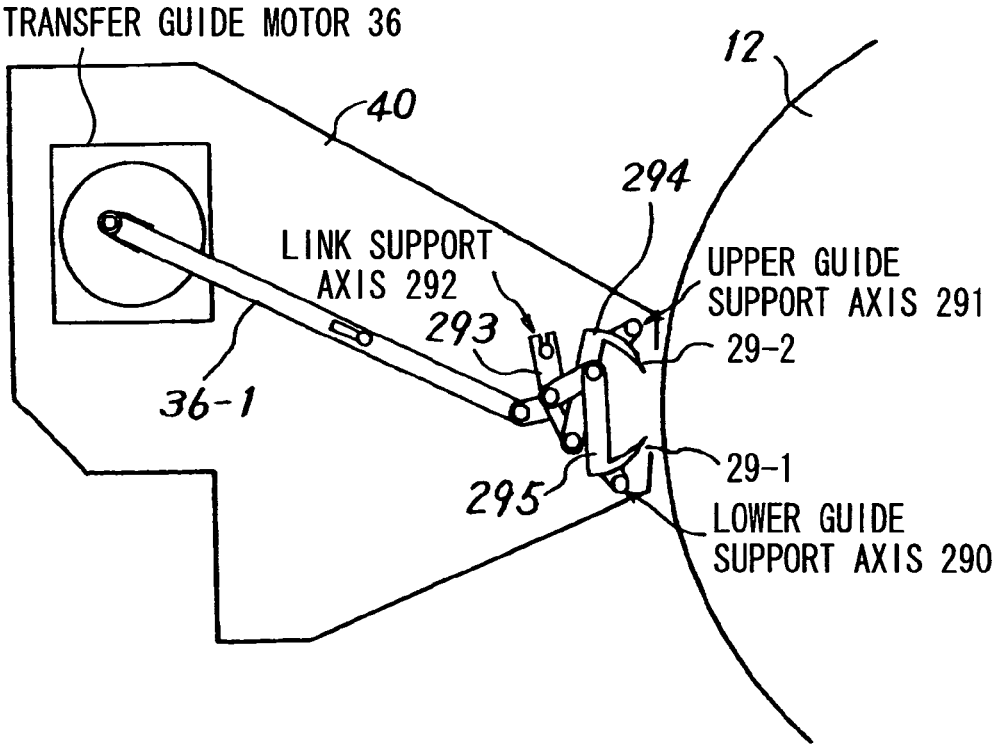
FIG. 8 shows in detail the operation of the transfer roller guide mechanism shown in FIG. 7.

The transfer guide mechanism shown will be described referring to FIGS. 7 and 8. As shown in FIGS. 7 and 8, the drive lever 36-1, that engages the rotation axis, is disposed on the rotation axis of the transfer guide motor 36. The end of the drive lever 36-1 is connected to the left end of the link 293 provided rotatably on the link support axis 292. The end of the upper transfer guide member 29-2 and the end of the lower transfer guide member 29-1 are connected to the link 293. The upper transfer guide member 29-2 is rotatably mounted on the upper transfer guide member support axis 291. The lower transfer guide member 29-1 is rotatably mounted on the lower transfer guide support axis 290.

Accordingly, in the retracted state shown in FIG. 8, the drive lever 36-1 moves in the direction of the arrow and rotates the link 293 counter-clockwise around the link support axis 292, when the transfer guide motor 36 rotates in the direction shown in FIG. 7. Thus, the lower transfer guide member 29-1 rotates clockwise around the rotation support axis 290, and the upper transfer guide member 29-2 rotates counter-clockwise around the rotation support axis 291. Accordingly, the transfer guide members 29-1 and 29-2 are pushed forward so as to assist the transfer process.

Conversely, in the transferring state shown in FIG. 7, the drive lever 36-1 returns to the position shown in FIG. 8 and rotates the link 293 clockwise around the link support axis 292, when the transfer guide motor 36 further rotates in the direction shown in FIG. 7. Thus, the lower transfer guide member 29-1 rotates counter-clockwise around the rotation support axis 290, and the upper transfer guide member 29-2 rotates clockwise around the transfer support axis 291. Accordingly, the transfer guide members 29-1 and 29-2 are pulled backward. The transfer roller 16 moves to the retracted state.

Figure 9:
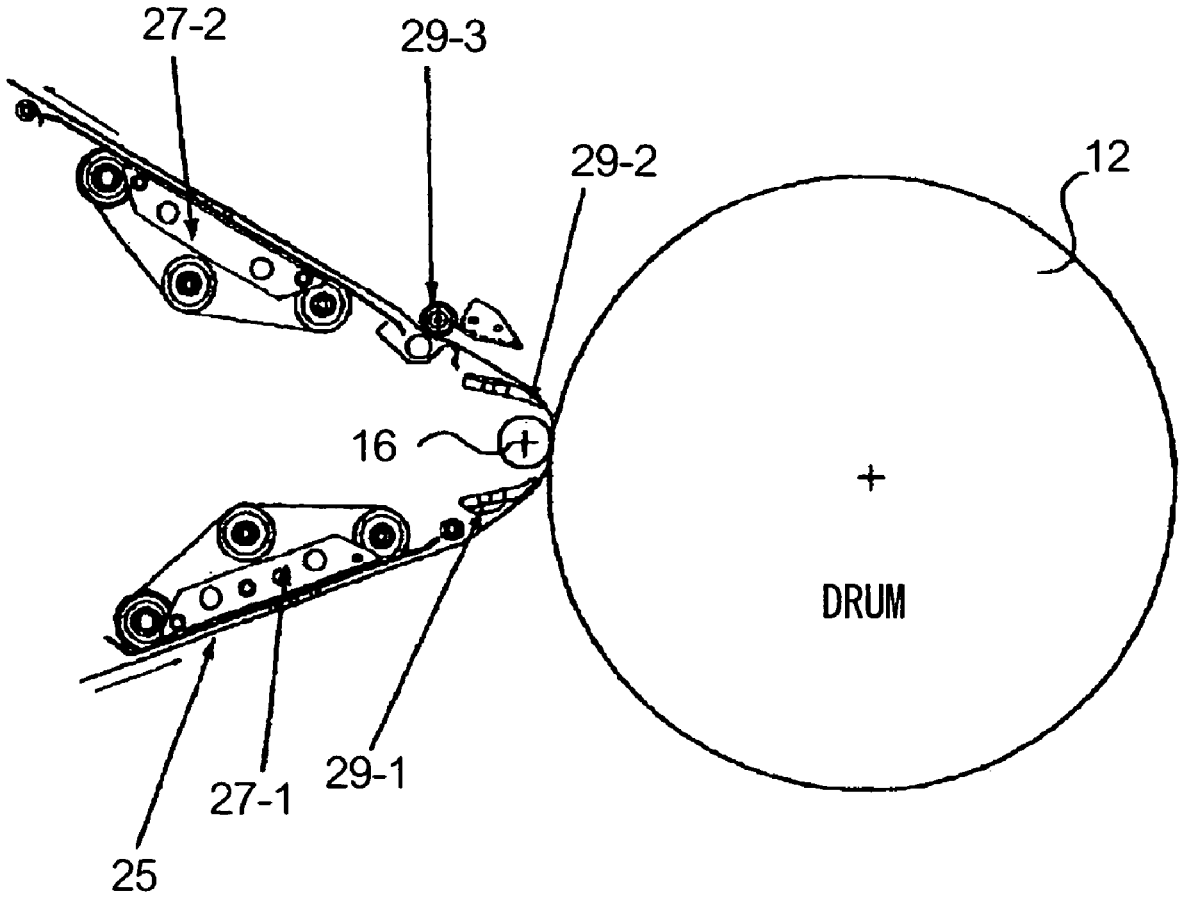
FIG. 9 shows in detail the contact operation in the transfer section of the drive mechanism shown in FIG. 3.

FIG. 3 shows the retracted state of the transfer roller 16. FIG. 9 shows the contact state of the transfer roller 16, corresponding to the retracted state shown in FIG. 3. In the retracted state shown in FIG. 3 the transfer roller 16, the transfer guide members 29-1 and 29-2 are retracted from the photoconductive drum 12. Accordingly the continuous paper 25 runs along the retracted transfer guide members 29-1 and 29-2 so that the continuous paper separates from the photoconductive drum 12. The transfer roller 16 also leaves the continuous paper 25.

On the contrary, in the contact state shown in FIG. 9, the transfer roller 16 moves toward the photoconductive drum 12. Accordingly the continuous paper 25 is pinched between the transfer roller 16 and the photoconductive drum 12. Namely, the contact type transfer operation may be performed. In this instance, the transfer guide members 29-1 and 29-2 are pushed forward and the continuous paper 25 is moved, at upper and undersides of the transfer roller 16, toward the photoconductive drum 12. Accordingly, in the transfer process, the tight contact region between the continuous paper 25 and the photoconductive drum 12 is enlarged. Thus, even if the convey path of the continuous paper 25 is U-turned at the transfer section as shown in FIGS. 1, 3, 9, the continuous paper 25 may be reliably pinched between the transfer roller 16 and the photoconductive drum 12. Accordingly, a poor quality of transfer may be avoided.

As described above, the transfer roller 16 is configured to be rotatable at any time. The transfer roller 16, the transfer guide members 29-1 and 29-2 are configured to be retracted. The mechanical controller 4 controls these mechanisms in the print process, as described later.

[Print Process]

Figure 10:
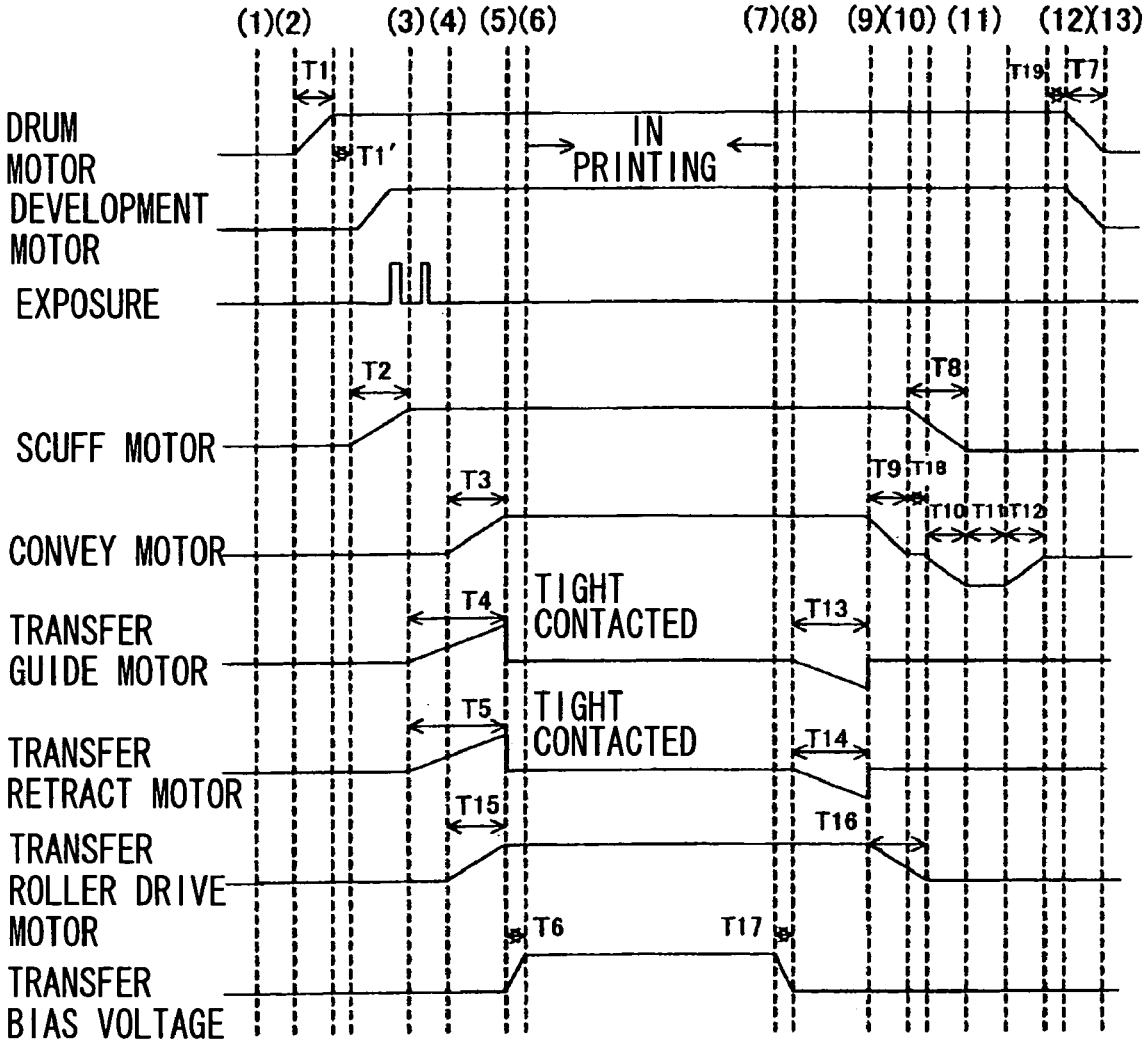
FIG. 10 shows a timing chart of the print operation of the configuration shown in FIG. 1.
Figure 11:
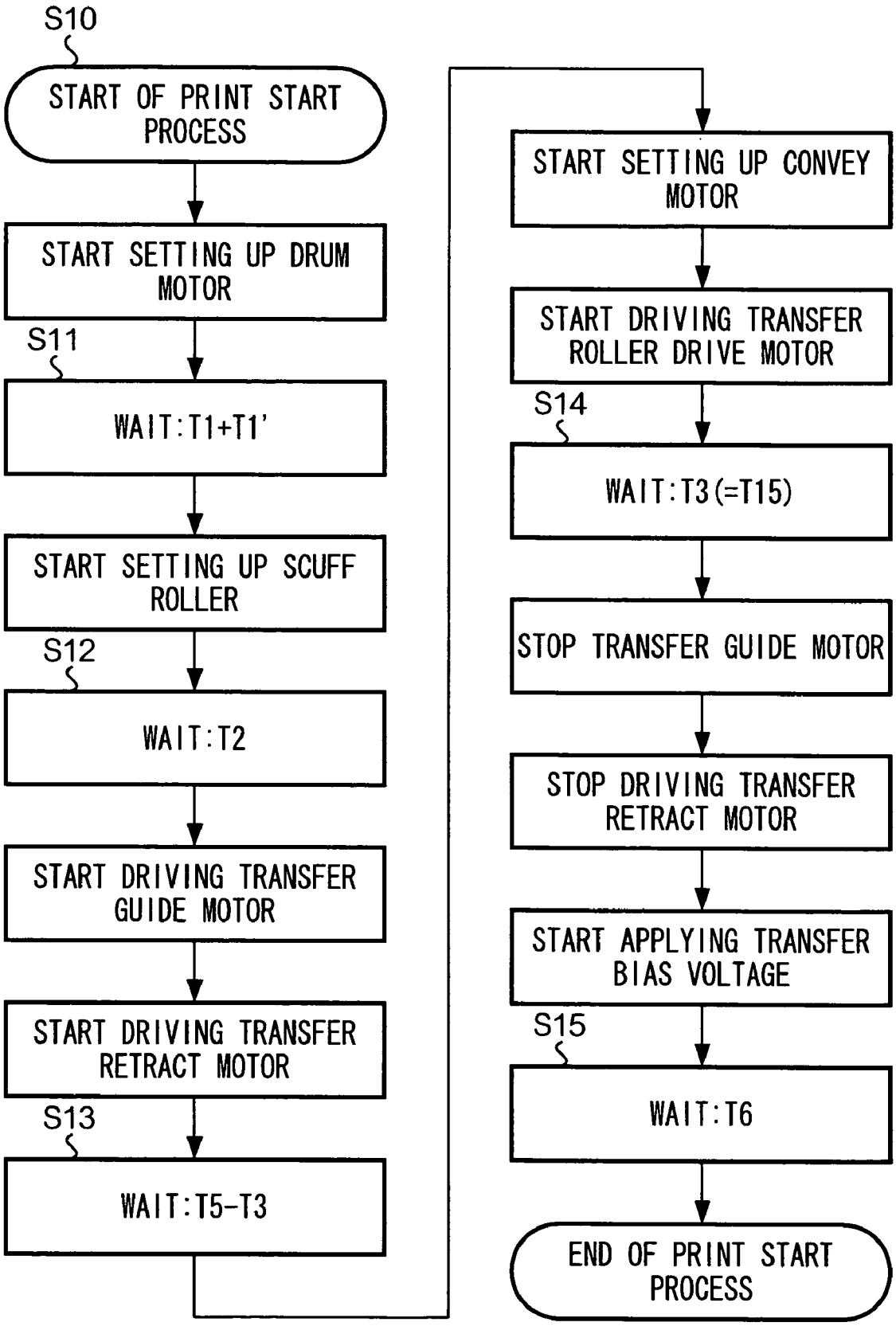
FIG. 11 shows a flow chart of the print start process shown in FIG. 10.
Figure 12:
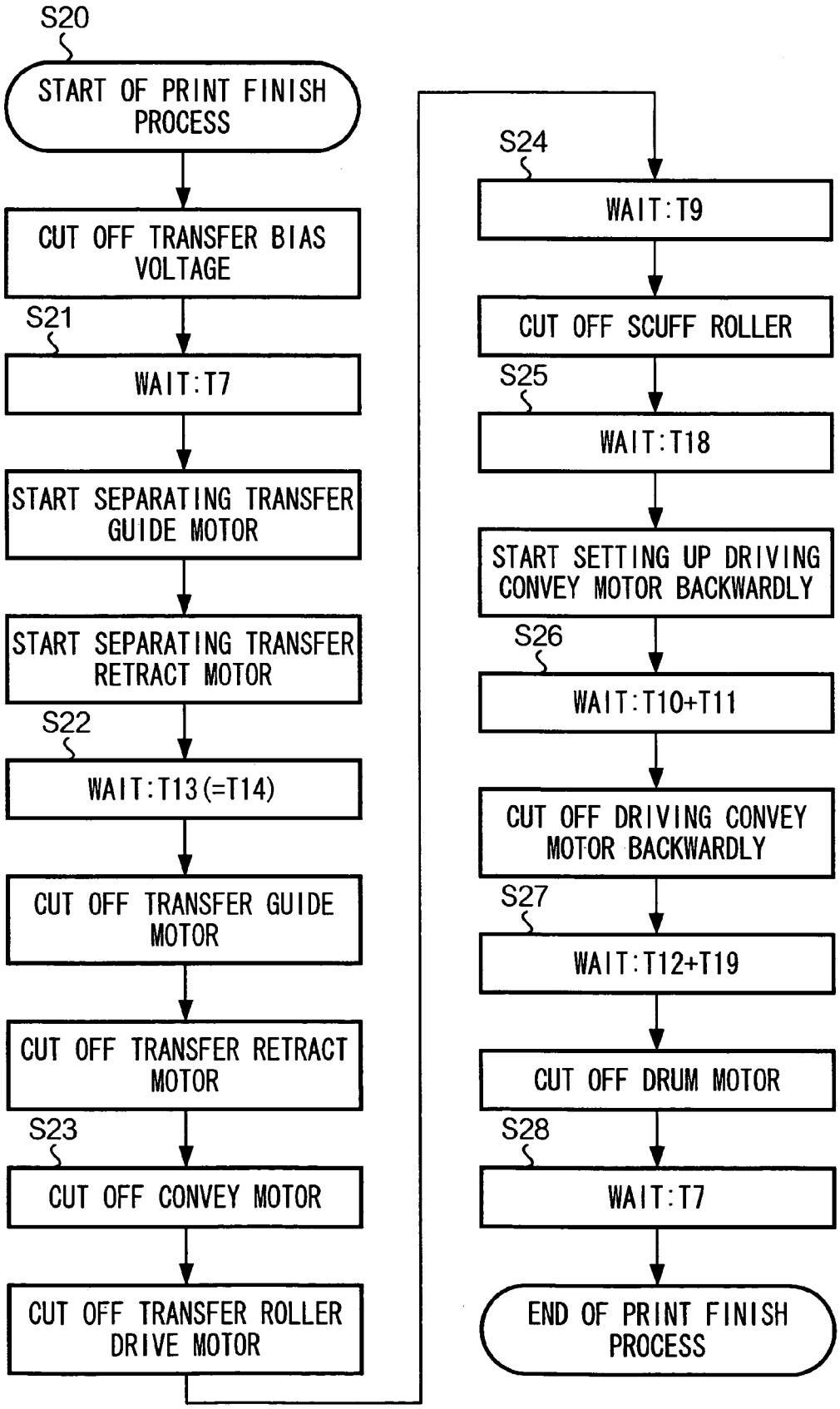
FIG. 12 shows a flow chart of the print finish process shown in FIG. 10.

FIG. 10 shows a timing chart in the print process according to an embodiment of the present invention. FIG. 11 shows a flow chart of the print start process in the print process according to the embodiment of the present invention. FIG. 12 shows a flow chart of the print finish process in the print process according to the embodiment of the present invention. FIGS. 13 to 18 show in detail the operation of the print start process shown in FIG. 11. FIGS. 19 to 25 show in detail the operation of the print finish process shown in FIG. 12.

The print start process will be described referring to FIG. 11 and the timing chart shown in FIG. 10.

Figure 13:
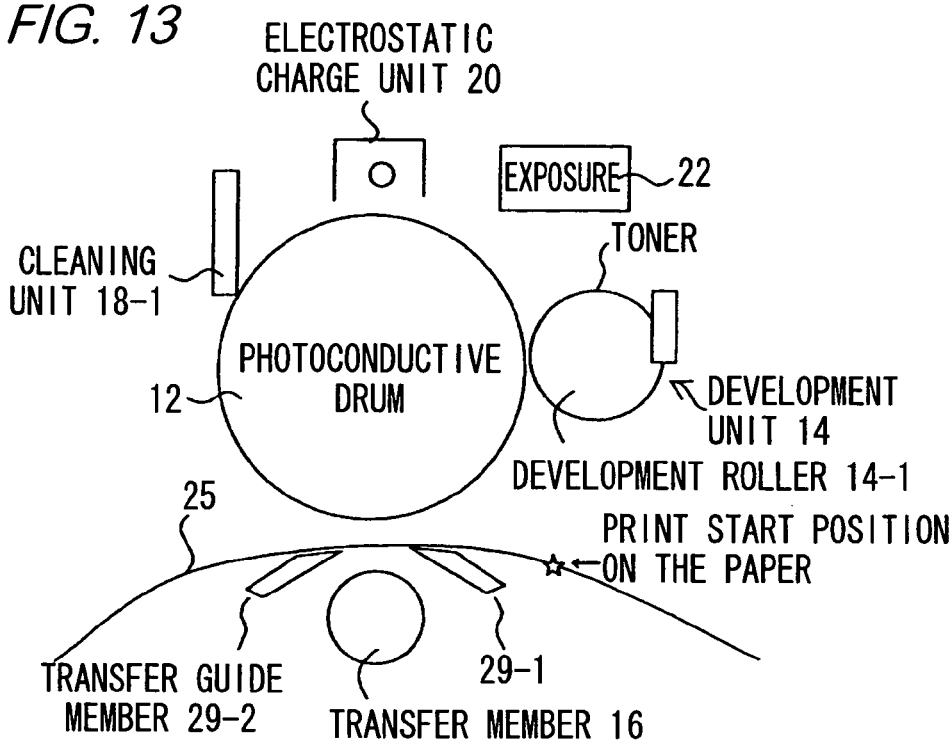
FIG. 13 shows in detail the operation of the apparatus while the apparatus is in a stationary state as shown in FIG. 10.

(1) As shown in FIG. 13, the transfer roller 16 and the transfer guide members 29-1 and 29-2 are retracted from the photoconductive drum 12, prior to starting printing. The photoconductive drum 12 and the transfer roller 16 are not rotating. The continuous paper 25 is also not moving. A print start position on the continuous paper 25 (for example, a perforated line in the zigzag folded paper shown in FIG. 2) is situated behind the transfer position. The continuous paper 25 (the last printed page of the previous print job) is pinched between the photoconductive drum 12 and the transfer roller 16.

Figure 14:
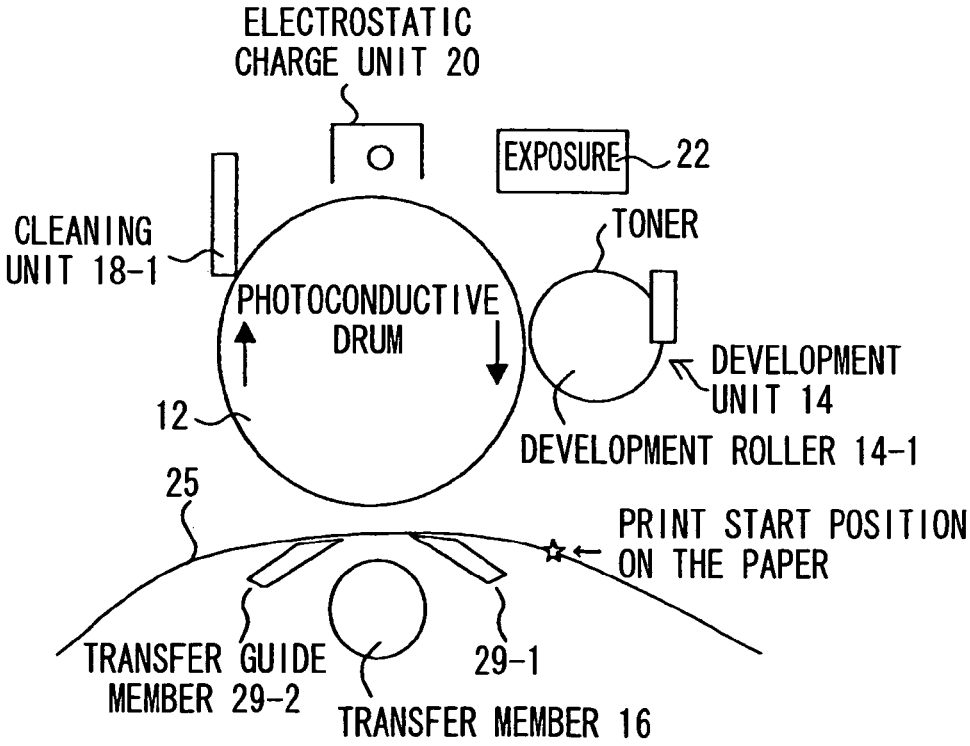
FIG. 14 shows in detail the operation of the apparatus when the drum starts rotating as shown in FIG. 10.

(2) On receiving print instructions from the controller 1, the mechanical controller 4 starts driving the drum motor 30 (Step S10 in FIG. 11). As shown in FIG. 14, the photoconductive drum 12 starts rotating. Within the time T1, the photoconductive drum 12 starts up and reaches a preset number of revolutions. After a lapse of the time (T1+T1'), the mechanical controller 4 starts driving the scuff motor 33 (Step S11 in FIG. 11). Accordingly, the scuff roller 28 rotates and then exerts a tensile force on the continuous paper 25. At the same time the mechanical controller 4 starts driving the electrostatic charge unit 20, the expose unit 22 as well as starting driving the development motor 31 in the development unit. Note that T1' means a waiting time until the photoconductive drum 12 rotates in a stable manner.

Figure 15:
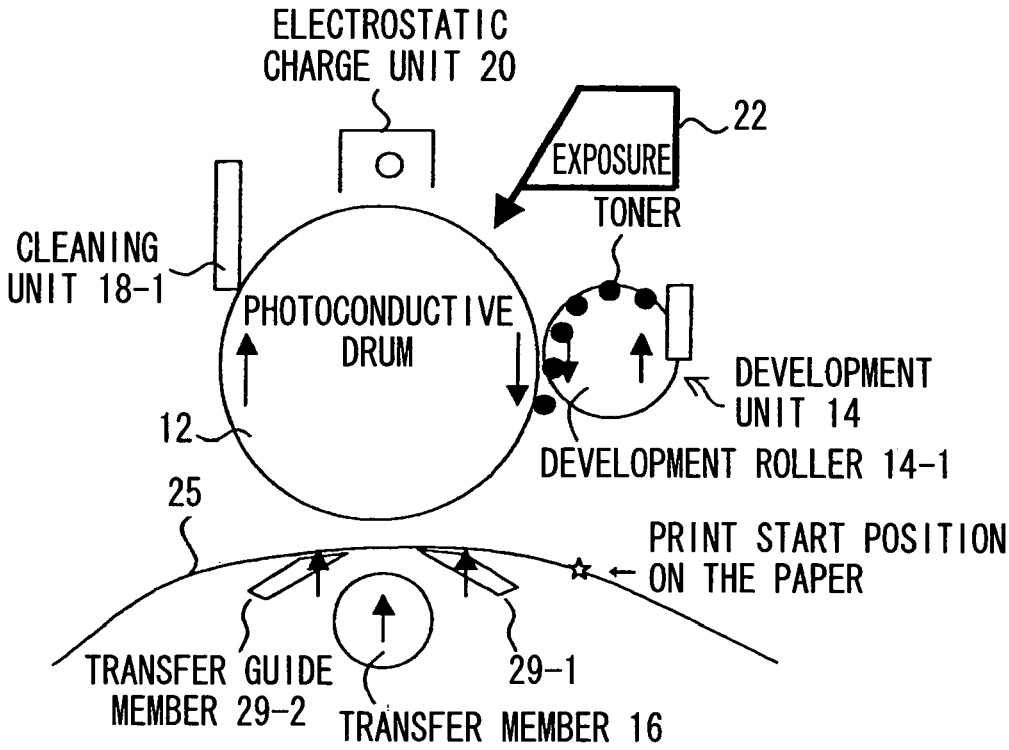
FIG. 15 shows in detail the operation of the apparatus when the transfer guide member and the transfer roller start moving as shown in FIG. 10.

(3) After a lapse of the time T2, the mechanical controller 4 starts driving the transfer guide motor 36 and the transfer retract motor 35 (Step S12 in FIG. 11). Thus, as shown in FIG. 15, the transfer roller 16 and the transfer guide members 29-1 and 29-2 start moving.

Figure 16:
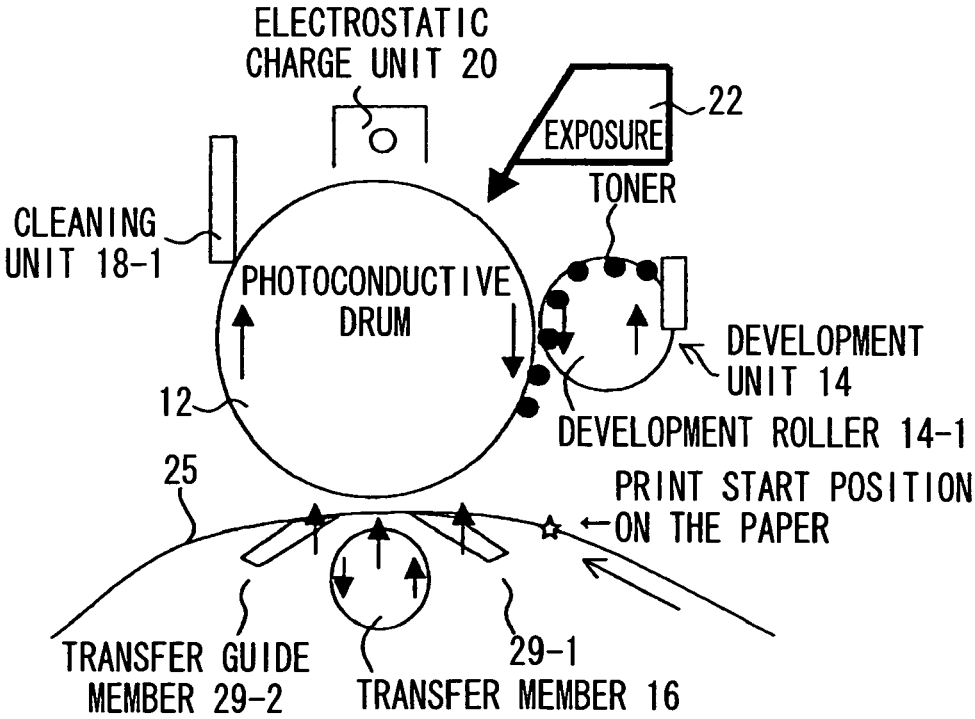
FIG. 16 shows in detail the operation of the apparatus when the transfer roller starts rotating and the paper being conveyed as shown in FIG. 10.

(4) After a lapse of the time (T5–T3), the mechanical controller 4 starts driving the transfer roller drive motor 34 and the convey motor 32 (Step S13 in FIG. 11). Thus, as shown in FIG. 16, the transfer roller 16 further rotates and then the continuous paper is conveyed. Before contact with the transfer roller 16, the photoconductive drum 12 and the transfer roller 16 are rotating and the continuous paper 25 is moving.

Figure 17:
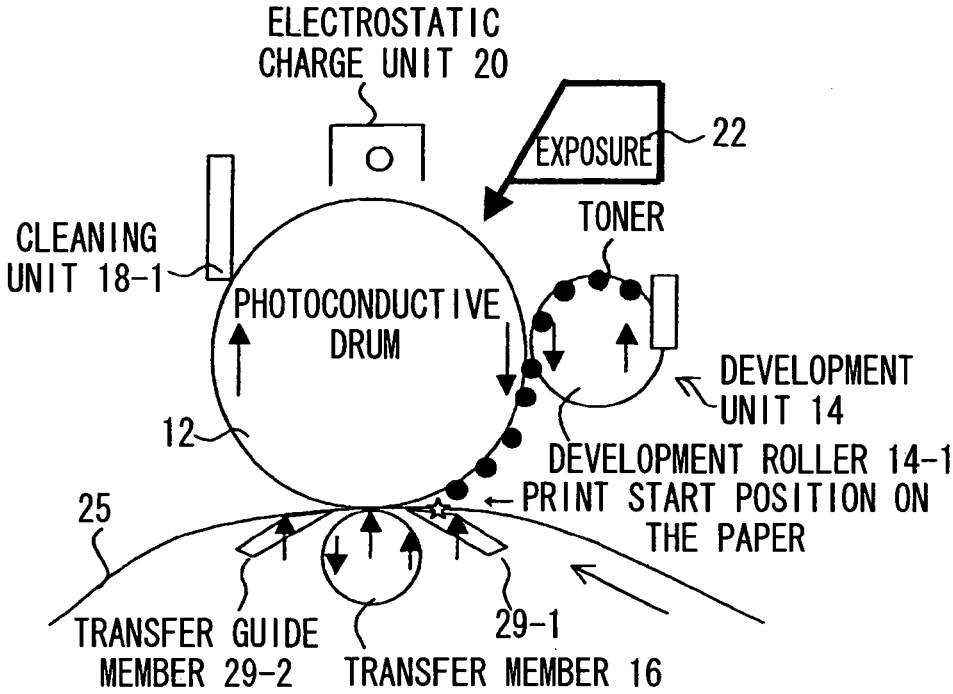
FIG. 17 shows in detail the operation of the apparatus when the drum contacts with the transfer roller as shown in FIG. 10.

(5) After a lapse of the time T3, the mechanical controller 4 stops driving the transfer retract motor 35 and the transfer guide motor 36 and starts applying the transfer bias voltage on the transfer roller 16 (Step S14 in FIG. 11). Thus, as shown in FIG. 17, the photoconductive drum 12, and the transfer roller 16 contact with the continuous paper 25. The continuous paper 25 is pinched between the photoconductive drum 12, and the transfer roller 16. The photoconductive drum and the transfer roller 16 are rotating and the continuous paper 25 is moving. Thus the transfer roller 16 contacts with the continuous paper 25.

Figure 18:
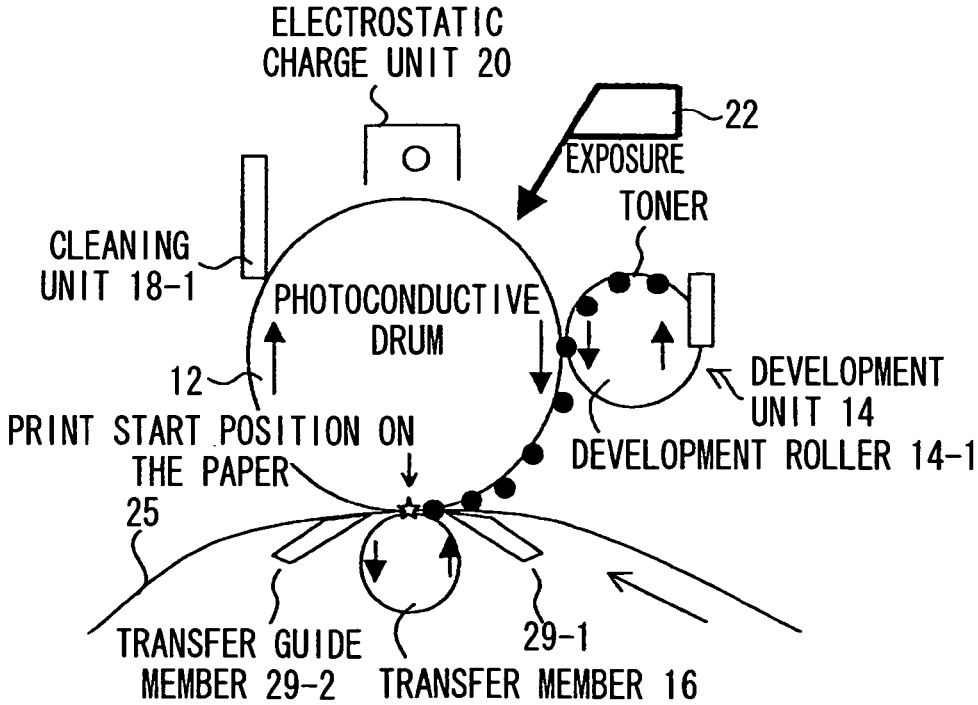
FIG. 18 shows in detail the operation of the apparatus when the transfer process begins as shown in FIG. 10.

(6) After a lapse of the time T6, the bias voltage is rapidly increased. Then the toner image formed on the photoconductive drum 12 starts to be transferred onto the continuous paper 25 as shown in FIG. 18. Thus the mechanical controller 4 finishes the print start process (Step S15 in FIG. 11).

The transfer roller 16 contacts, while rotating, with the photoconductive drum 12 via the paper 25. Accordingly the difference in speed between the paper 25 and the transfer roller 16 may be reduced. Since the paper 25 is also moving, the frictional force exerted on the paper 25 may be reduced. Then the adherence of the toner from the transfer roller 16 onto the paper 25 may be reduced. Thus stains on the back side of the paper 25 may be avoided.

The transfer guide members 29-1 and 29-2 guide the paper 25 in the transfer section as well as guiding the paper 25 prior to the transfer process so that the paper 25 does not contact with the photoconductive drum 12 and/or the transfer roller 16.

The print finish process will be described referring to FIG. 12 and the timing chart shown in FIG. 10.

Figure 19:
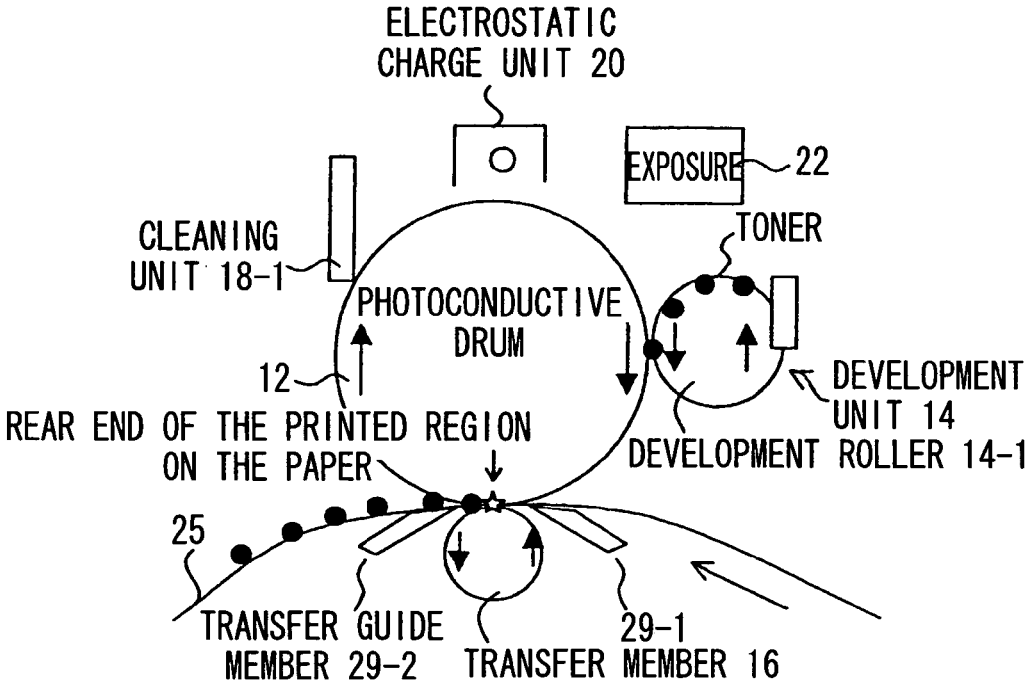
FIG. 19 shows in detail the operation of the apparatus when the print process finishes as shown in FIG. 10.

(7) The mechanical controller 4 stops applying the transfer bias voltage so as to finish the transfer process (Step S20 in FIG. 12). Namely, as shown in FIG. 19, the transfer bias voltage is cut off, when the rear end of the printed region on the continuous paper passes the contact line between the photoconductive drum and the transfer roller 16.

Figure 20:
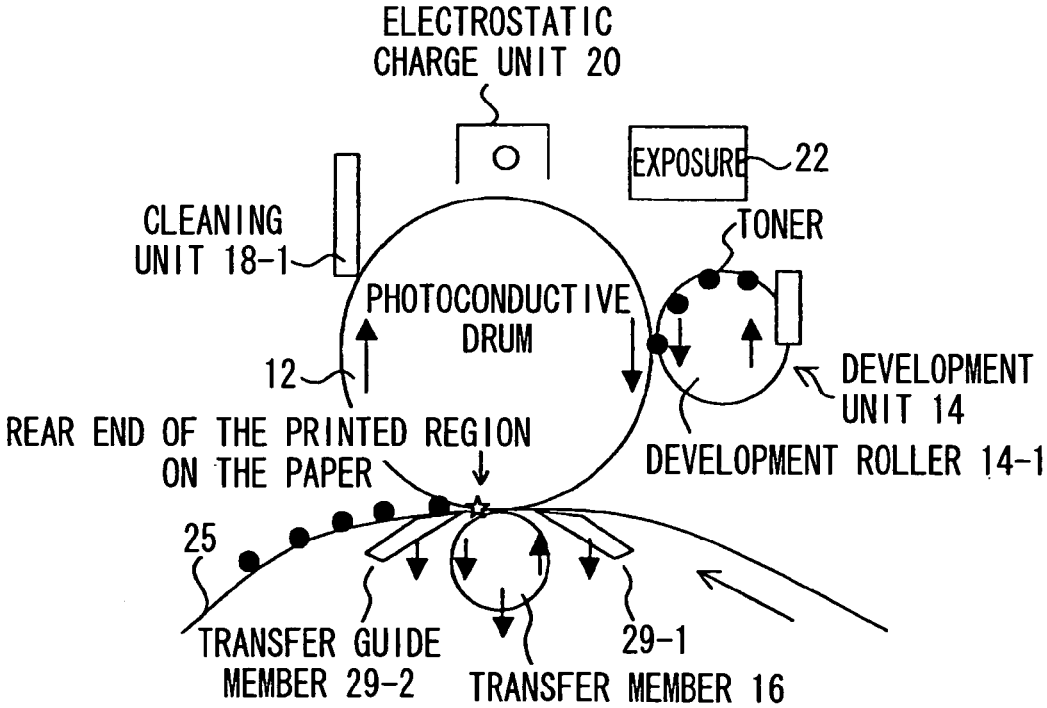
FIG. 20 shows in detail the operation of the apparatus when the transfer guide member and the transfer roller start retracting as shown in FIG. 10.
Figure 21:
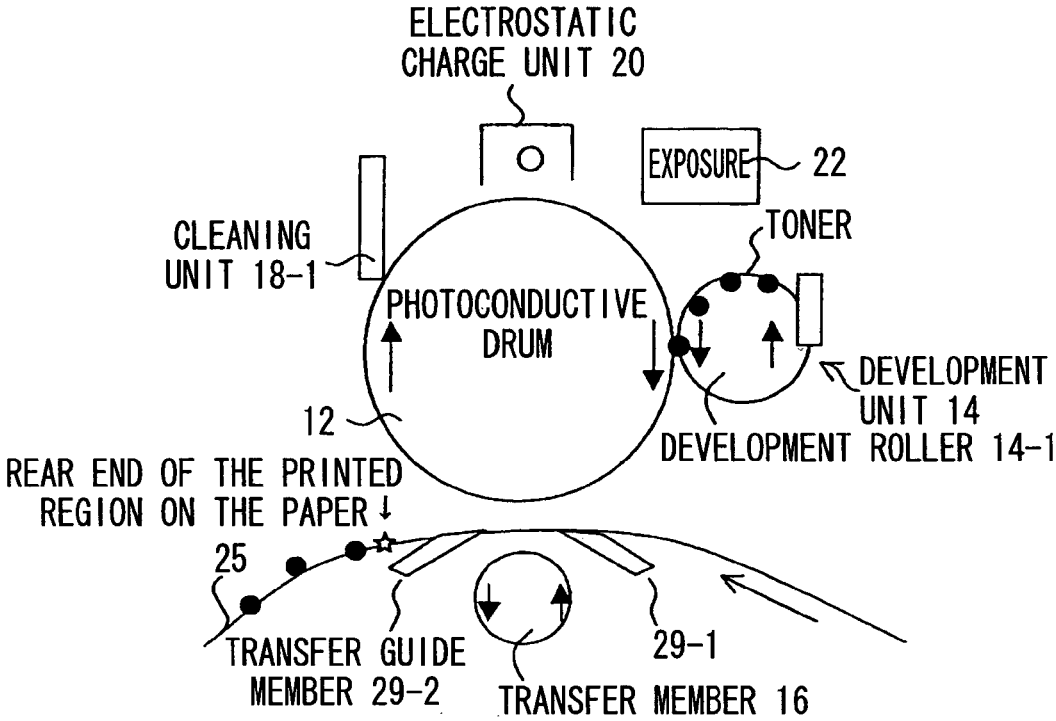
FIG. 21 shows in detail the operation of the apparatus when the transfer roller stops rotating and the paper stops being conveyed as shown in FIG. 10.

(8) After a lapse of the time T17, the mechanical controller 4 starts driving the transfer guide motor 36 and the transfer retract motor 35 (Step S21 in FIG. 21). As shown in FIG. 20, the transfer roller 16 and the transfer guide members 29-1 and 29-2 start leaving the photoconductive drum 12. The waiting time T17 means a time until the transfer bias voltage starts up and reaches a specific voltage. Thus the transfer roller 16 may be retracted when the transfer bias voltage is completely cut off. Accordingly an unnecessary discharge may be avoided.

(9) After a lapse of the time T13 (=T14), the mechanical controller 4 stops driving the transfer retract motor 35 and the transfer guide motor 36 (Step S22 in FIG. 12). The mechanical controller 4 stops driving the convey motor 32 and the transfer roller drive motor 34 (Step S23 in FIG. 12). Thus, as shown in FIG. 21, the photoconductive drum 12 and the transfer roller 16 are separated from the continuous paper 25. The continuous paper 25 stops its motion so that the rear end of the printed region on the continuous paper 25 is situated downstream of the transfer region. Namely, the transfer roller 16 is retracted, while the photoconductive drum 12 and the transfer roller 16 are rotating and the continuous paper 25 is moving.

Figure 22:
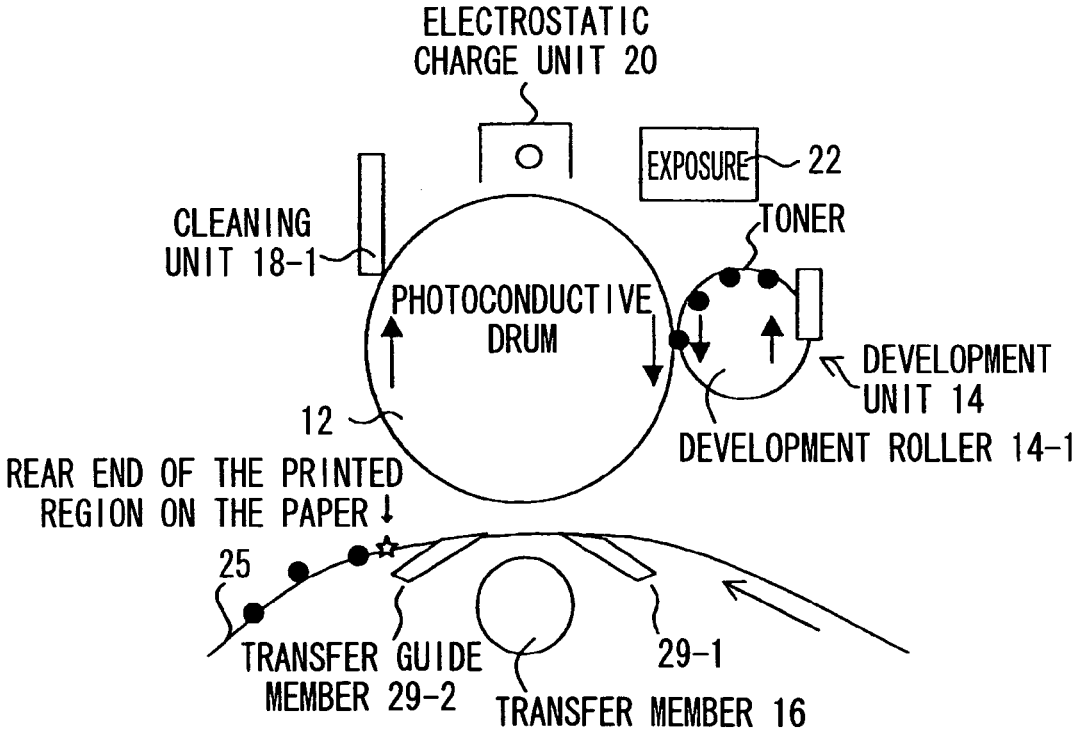
FIG. 22 shows in detail the operation of the apparatus when the paper starts being fed backward as shown in FIG. 10.

(10) After a lapse of the time T9, the mechanical controller 4 turns off the scuff motor 33 (Step S23 in FIG. 12). Thus, as shown in FIG. 22, a tensile force is applied to the continuous paper 25. After a lapse of the time T18, the mechanical controller 4 starts driving the scuff motor 33 backward (Step S25 in FIG. 12). Thus, as shown in FIG. 22, the continuous paper 25 starts moving backward.

Figure 23:
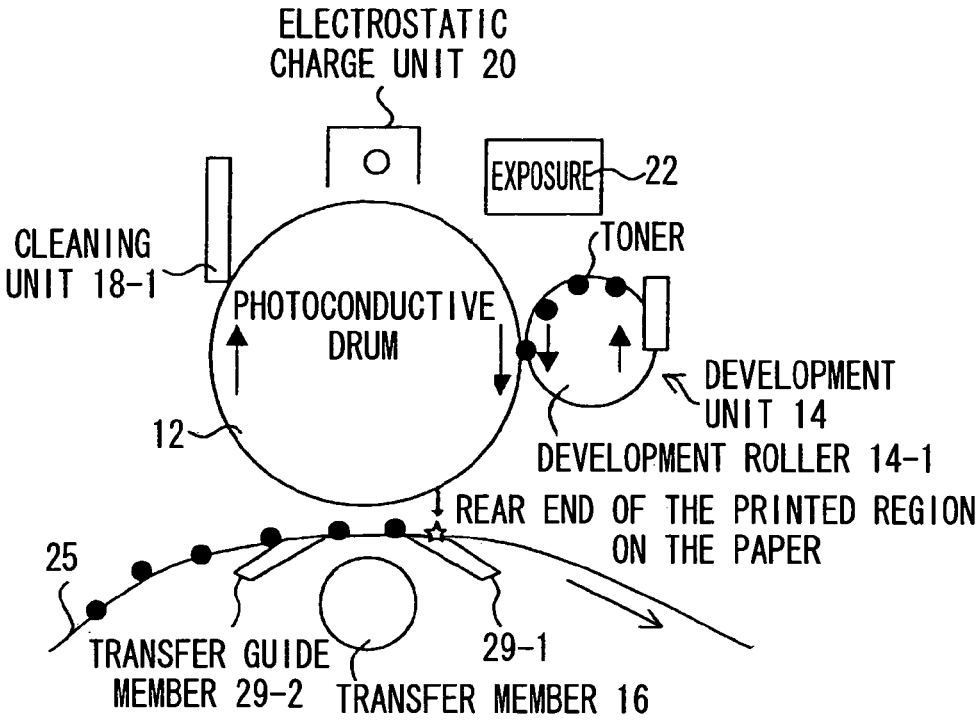
FIG. 23 shows in detail the operation of the apparatus while the paper is being conveyed backward as shown in FIG. 10.

(11) As shown in FIG. 23, the continuous paper 25 is fed backward.

Figure 24:
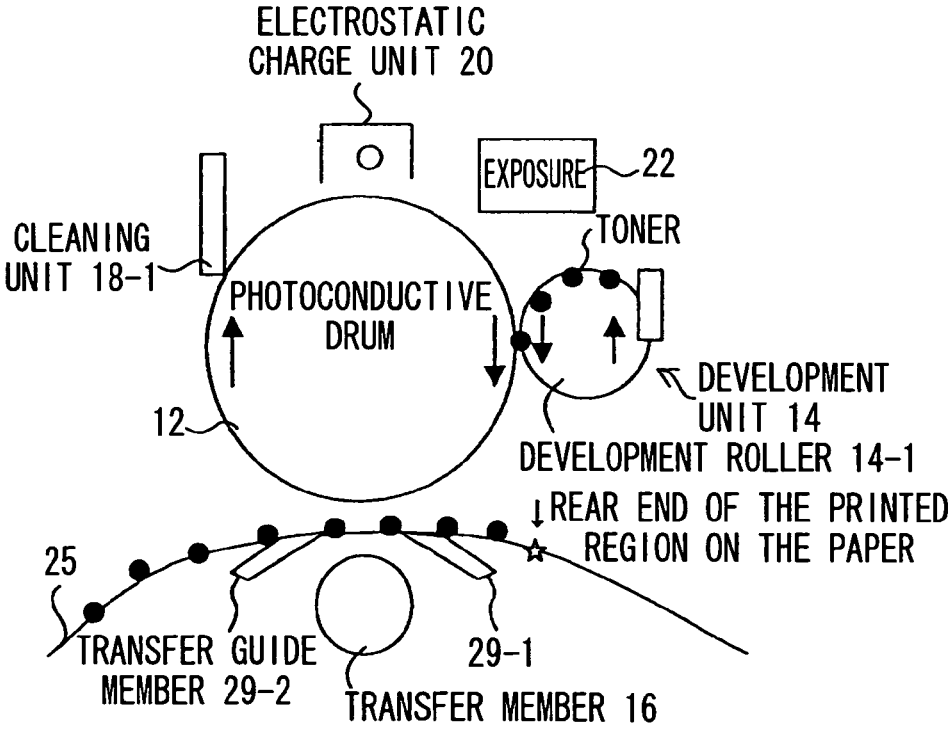
FIG. 24 shows in detail the operation of the apparatus when the drum begins to stop its rotation as shown in FIG. 10.

(12) After a lapse of the time (T10+T11), the mechanical controller 4 stops driving the convey motor 32 backward. As shown in FIG. 24, after a lapse of the time T12, the continuous paper 25 stops its motion (Step S26 in FIG. 12).

Figure 25:
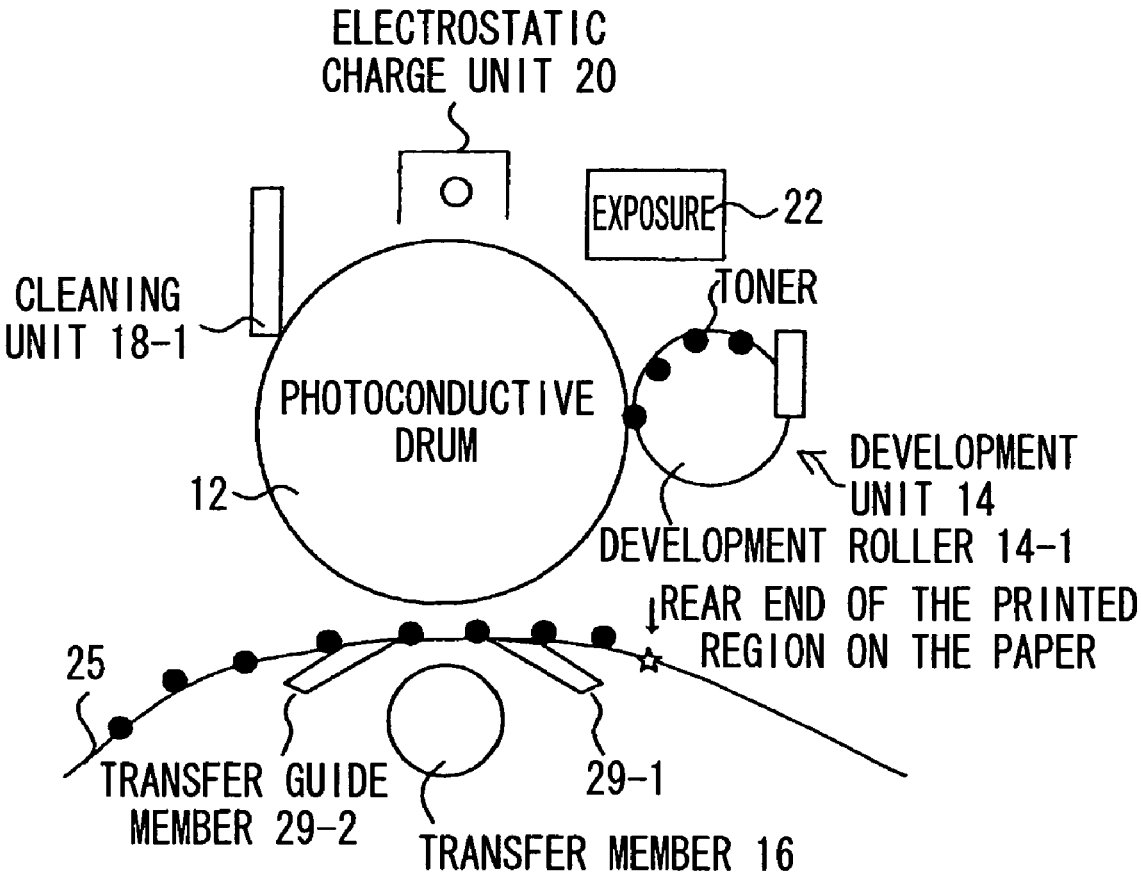
FIG. 25 shows in detail the operation of the apparatus when the drum stops its rotation as shown in FIG. 10.

(13) After a lapse of the time (T12+T19), the mechanical controller 4 stops driving the drum motor 30 and the development motor 31 (Step S27 in FIG. 12). After a lapse of the time T7, the mechanical controller 4 finishes the print finish process (Step S28 in FIG. 12). Thus as shown in FIG. 25, the photoconductive drum 12 and the development roller 14-1 also stop their rotation.

The transfer roller 16 is retracted, while rotating, from the photoconductive drum 12 and the paper 25. Accordingly, the friction force exerted from the transfer roller 16 onto the paper 25 may be reduced. Thus the adherence of the toner from the transfer roller 16 onto the paper 25 may be reduced. Accordingly stains on the back side of the paper may be avoided.

The speed of conveying the continuous paper 25 and the speed of rotating the transfer roller 16 are set at a substantially identical speed. Then the transfer roller 16, that is retracted, contacts with the continuous paper 25. Accordingly, the concentration of the impact force and the friction may be reduced when the transfer roller 16 contacts with the continuous paper 25. Thus the transfer of the toner adhering to the transfer roller 16 onto the continuous paper 25 may be reduced. Accordingly stains on the back side of the paper may be avoided.

FIG. 26 shows an example of the speed differences between the transfer roller (the transfer member) 16, the paper 25 and the photoconductive drum 12 and stains on the back side of the paper. As shown in FIG. 26, no stains are found on the back side of the paper if the speed difference between the transfer roller 16 and the paper is in a range from −5% to +5%. Also, no stains are found on the back side of the paper if the speed difference between the photoconductive drum 12 and the transfer roller 16 is in a range from −5% to +5%.

Accordingly maintaining the speed differences between the transfer roller 16, the paper 25 and the photoconductive drum 12 is an effective way to avoid stains on the back side of the paper 25.

OTHER EMBODIMENTS

Figure 27:
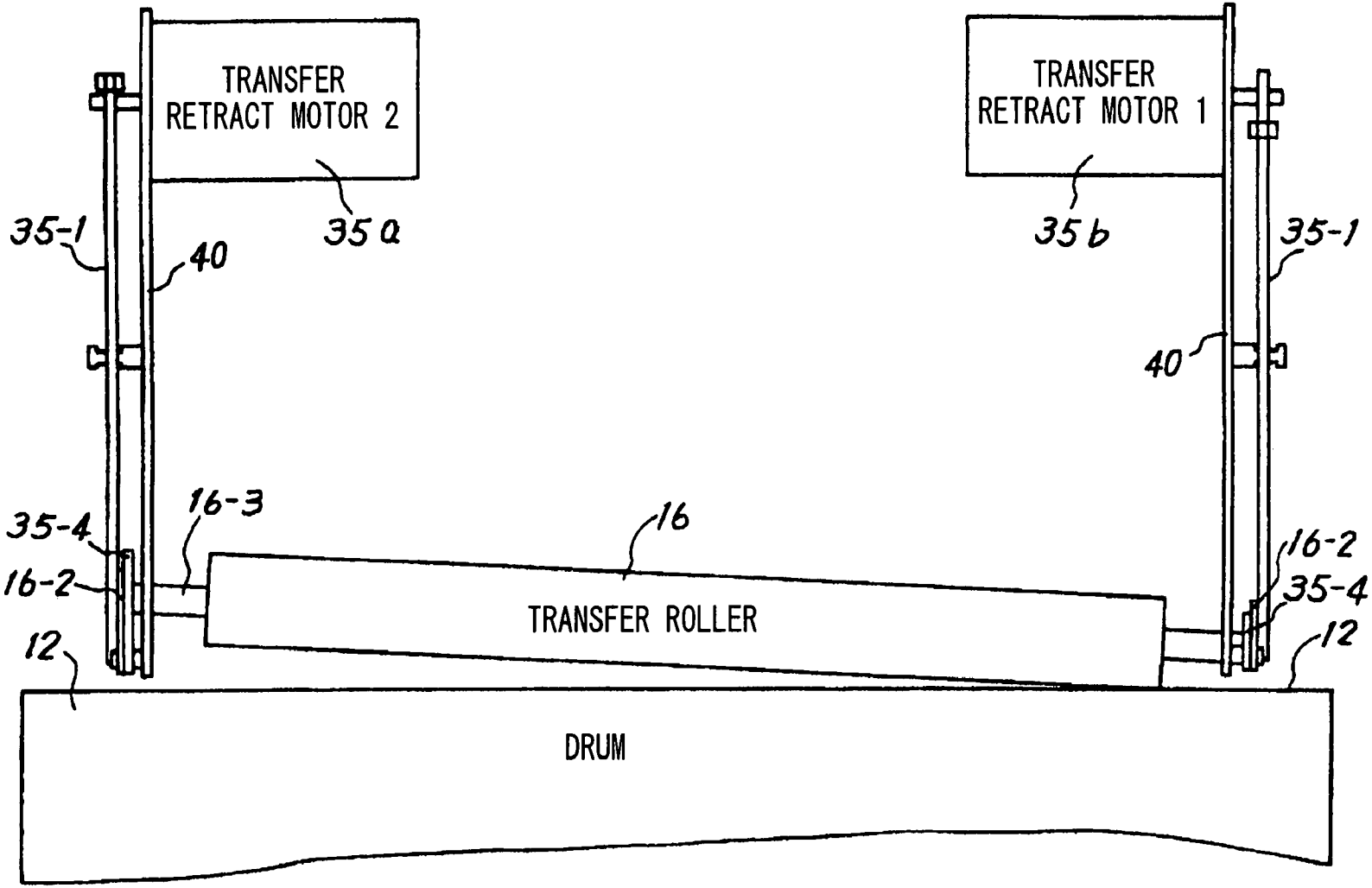
FIG. 27 shows a front view of the other embodiment transfer retract mechanism shown in FIG. 5.
Figure 28:
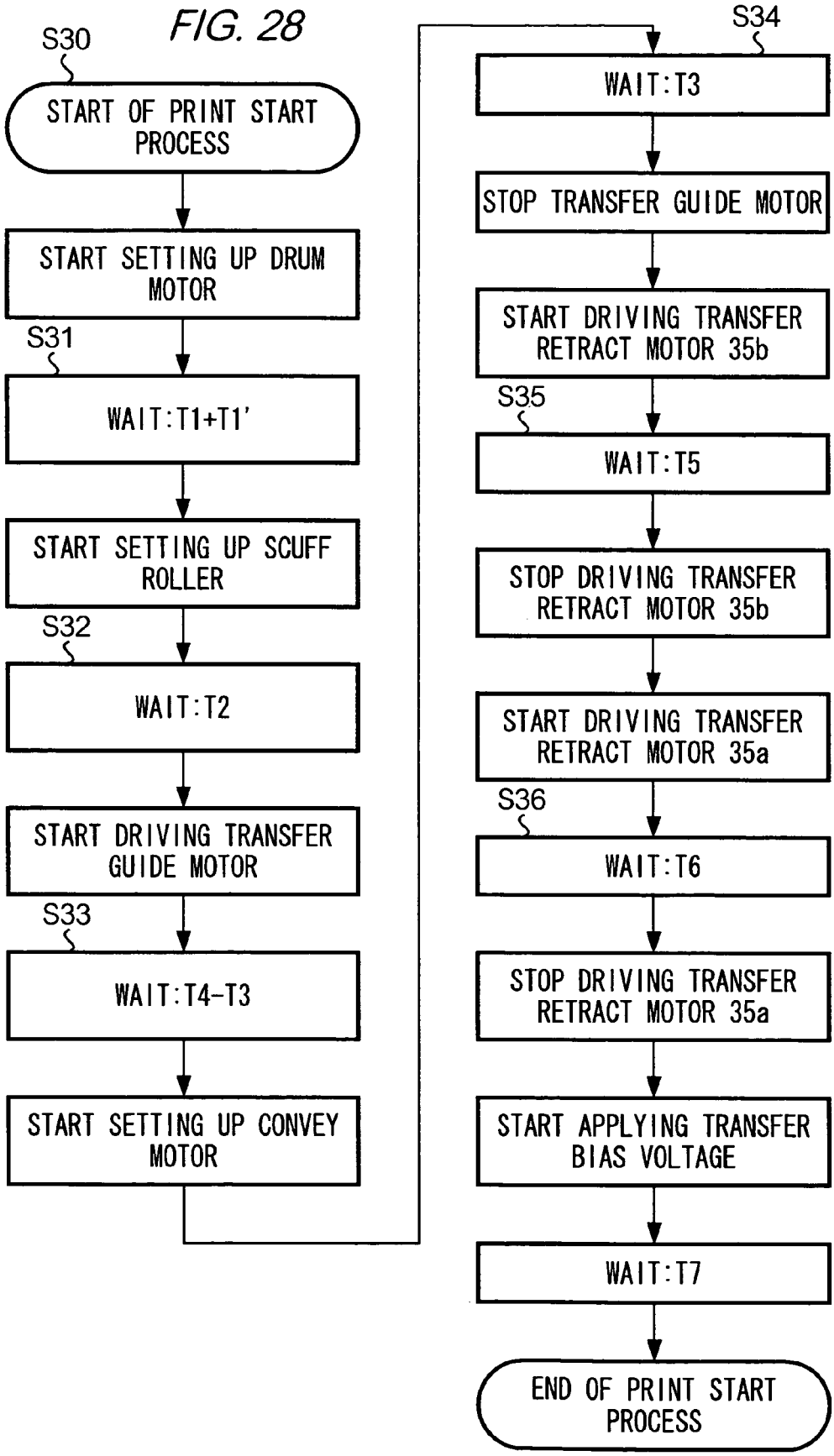
FIG. 28 shows a flow chart of the print start process in the embodiment shown in FIG. 27.
Figure 29:
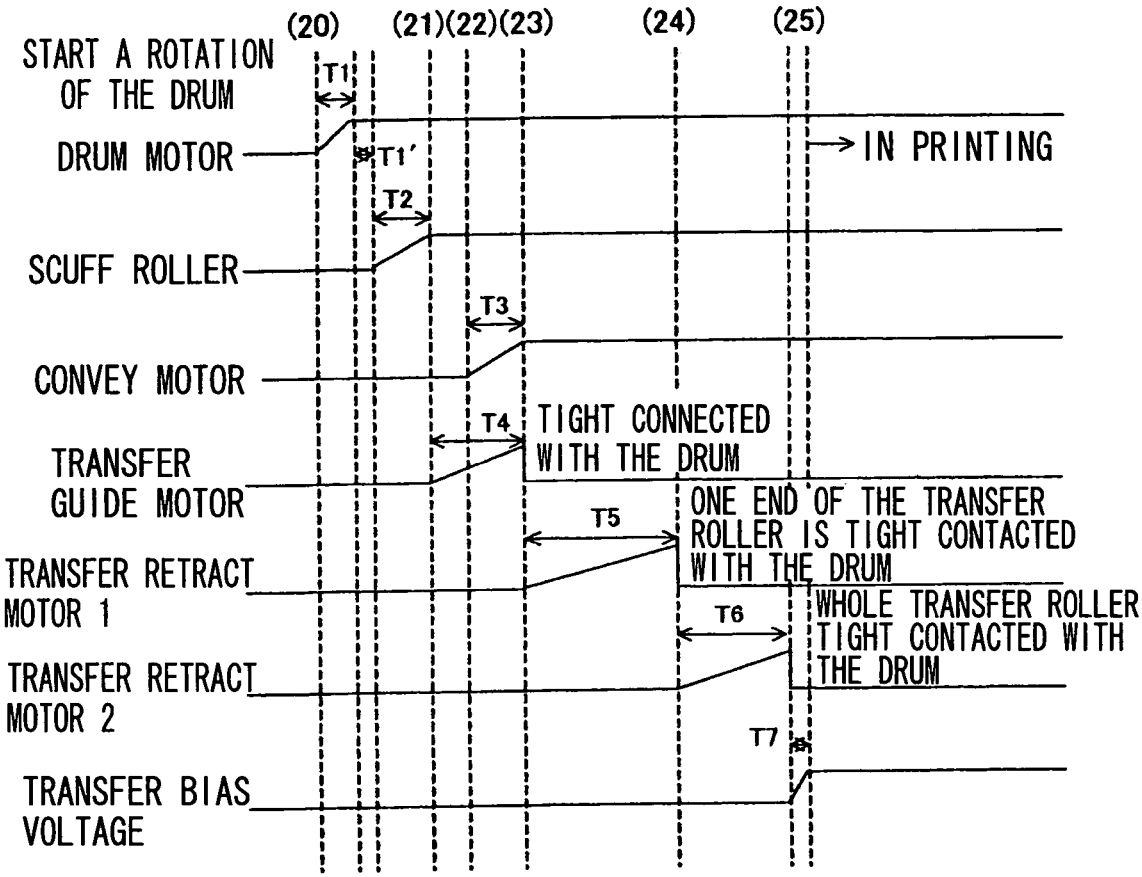
FIG. 29 shows a timing chart of the print process in the embodiment shown in FIG. 27.

FIG. 27 is a configuration diagram showing the transfer guide retract mechanism of the image forming apparatus according to another embodiment of the present invention. FIG. 28 is a flow chart showing the print start process according to the other embodiment of the present invention. FIG. 29 is a timing chart at the start of the print operation according to the other embodiment of the present invention.

FIG. 27 shows another embodiment of the transfer guide retract mechanism that differs from that shown in FIG. 5 in that the left and right independently operable retract mechanisms are provided for the transfer roller 16. Namely, the transfer retract motor 35*a*, the drive lever 35-1, the drive arm 35-4 and the rotation arm 16-2 are provided on the left side wall 40. The left end of the rotation axis 16-3 of the transfer roller 16 is retracted from the left side wall 40.

The transfer retract motor 35*b*, the drive lever 35-1, the drive arm 35-4 and the rotation arm 16-2 are provided on the right side wall 40. The right end of the rotation axis 16-3 of the transfer roller 16 is retracted from the right side wall 40.

As shown in FIG. 27 before the whole transfer roller 16 contacts with the photoconductive drum 12, part (right end in the FIG. 27) of the transfer roller 16 contacts with the photoconductive drum 12. The transfer roller 16 then may be rotated by way of the rotational force of the photoconductive drum 12. Then the whole transfer roller 16 contacts with the photoconductive drum 12.

The print start operation according to the embodiment is described referring to FIG. 28 and a timing chart shown in FIG. 29.

(20) Prior to the print operation, the transfer roller 16, the transfer guide members 29-1 and 29-2 are retracted from the photoconductive drum 12. The photoconductive drum 12 and the transfer roller 16 stop their rotation. The continuous paper 25 is also not moving. A print start position on the continuous paper 25 (for example, a perforated line in the zigzag folded paper shown in FIG. 2) is situated behind the transfer position. The continuous paper 25 (the last printed page of the previous print job) is pinched between the photoconductive drum 12 and the transfer roller 16.

On receiving print instructions from the controller 1, the mechanical controller 4 starts driving the drum motor 30 (Step S30 in FIG. 28). As shown in FIG. 14, the photoconductive drum 12 starts rotating. Within the time T1, the photoconductive drum 12 starts up (reaches a preset number of revolutions). After a lapse of the time (T1+T1'), the mechanical controller 4 starts driving the scuff motor 33 (Step S31 in FIG. 28). Accordingly, the scuff roller 28 rotates and then exerts the tensile force on the continuous paper 25. At the same time the mechanical controller 4 starts driving the electrostatic charge unit 20, the expose unit 22 as well as starting driving the development motor 31 in the development unit. Note that T1' means a waiting time until the photoconductive drum 12 rotates in a stable rotation.

(21) After a lapse of the time T2, the mechanical controller 4 starts driving the transfer guide motor 36 (Step S32 in FIG. 28). Thus, as shown in FIG. 15, the transfer guide members 29-1 and 29-2 start moving toward the photoconductive drum 12. In the embodiment the transfer roller 16 does not start at this time.

(22) After a lapse of the time (T4−T3), the mechanical controller 4 starts driving the convey motor 32 (Step S33 in FIG. 28). Thus, as shown in FIG. 16, the continuous paper 25 is conveyed.

(23) After a lapse of the time T3, the mechanical controller 4 stops driving the transfer guide motor 36 and starts driving the right transfer roller retract motor 35*b* (Step S34 in FIG. 28). Thus, as shown in FIG. 27, before the whole transfer roller 16 contacts with the photoconductive drum 12, part (right end in the FIG. 27) of the transfer roller 16 contacts with the photoconductive drum 12. The transfer roller 16 then may be rotated by way of the rotational force of the photoconductive drum 12. Accordingly the photo conductive drum 12, the transfer roller 16 and the continuous paper 25 are moved before the continuous paper 25 is pinched between the photoconductive drum 12 and the transfer roller 16.

(24) After a lapse of the time T5, the mechanical controller 4 stops driving the right transfer roller retract motor 35*b* and start driving the left transfer roller retract motor 35*a* (Step S35 in FIG. 28).

(25) After a lapse of the time T6, the mechanical controller 4 stops driving the left transfer roller retract motor 35*a* (Step S36 in FIG. 28). Thus, the continuous paper 25 is pinched between the photoconductive drum 12 and the transfer roller 16. Namely, while the photoconductive drum 12 and the transfer roller 16 are rotating and the continuous paper 25 is moving, the transfer roller 16, which is rotating, contacts with the continuous paper 25. After a lapse of the time T7, the bias voltage is rapidly increased. Then the toner image formed on the photoconductive drum 12 starts to be transferred onto the continuous paper 25 as shown in FIG. 18. Thus the mechanical controller 4 finishes the print start process (Step S36 in FIG. 28).

The transfer roller 16 contacts, while rotating, with the photoconductive drum 12 via the paper 25. Accordingly, the difference in speed between the paper 25 and the transfer roller 16 may be reduced. Since the paper 25 is also moving, the frictional force exerted on the paper 25 may be reduced. Then the transfer of adhering toner from the transfer roller 16 onto the paper 25 may be reduced. Thus stains on the back side of the paper 25 may be avoided.

In the embodiment, the rotational force of the transfer roller may be gained from the photoconductive drum 12. Accordingly, the transfer roller drive motor 34 and the rotation mechanism may be omitted. It is to be noted that the print finish process is the same as that shown in FIG. 12.

Figure 30:
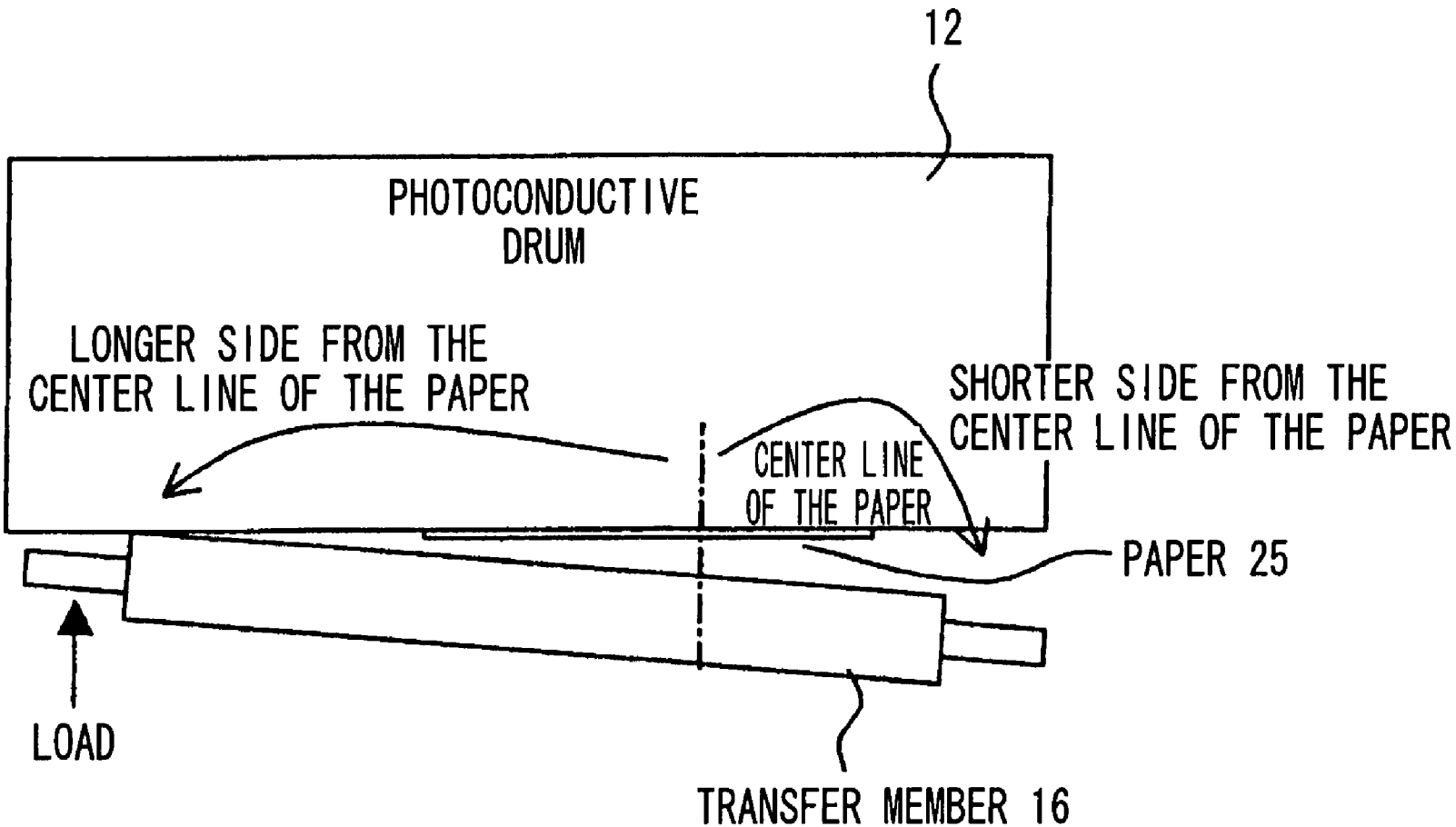
FIG. 30 shows in detail the operation of the embodiment shown in FIG. 27

FIG. 30 shows in detail the operation shown in FIG. 27. The end of the transfer roller 16 furthest from the center line of the paper 25 on the photoconductive drum 12 contacts with the photoconductive drum 12 prior to the full contact. The transfer roller 16 gains rotational force from the photoconductive drum 12. Then the transfer roller 16 contacts fully with the photoconductive drum 12. Similar operation and effect to the first embodiment may be realized even if the rotation drive mechanism is stripped away from the transfer roller.

In addition to the above mentioned embodiments, the following modifications may be applicable in the present invention (1) While zigzag folded paper with perforated lines is described in the above embodiments, the present invention may be applicable to a roll type paper. The continuous medium is not limited to being paper and may be a film one or the like. While a printer used in a computer system is described in the above embodiments, the present invention may be applicable to a photocopier or a facsimile.

(2) The transfer roller may include not only a member with a roller shape, such as a sponge roller or a rubber roller, but also a rotating brush and a member having a belt shape having a conveying function. Namely, the present invention may be applicable to a rotatable member having any shape.

(3) A single motor may work as both the transfer guide motor and the transfer retract motor in the above embodiments. A single motor may work as both the convey motor and the transfer roller drive motor. Furthermore a single motor may work as both the drum motor and the transfer roller drive motor.

(4) The transfer guide member may be configured to be not only movable but also fixed. The present invention may be applicable for a single side printing printer as well as a double side printing printer.

As mentioned above, the present invention has been described referring to the embodiments. However various modifications may be applicable within the scope of the technical essence of the present invention. These modifications may not be excluded.

INDUSTRIAL APPLICABILITY

By using the contact type transfer member and the retract mechanism so as to transfer a toner image onto a continuous medium, the transfer process may be stably performed onto various continuous media, and unnecessary transfer of toner from the contact type transfer member to the continuous medium may be reduced.

The unnecessary transfer of toner may be caused by a concentration of contact stress when the contact type transfer member, which is moved by a retract mechanism, contacts with the continuous medium. According to the present invention, the contact type transfer member contacts with the continuous medium while the continuous medium is steadily conveyed and the transfer member is steadily rotated so as to dissipate the contact stress. Accordingly, the transfer of the toner from the transfer member to the continuous medium may be reduced. Furthermore, friction at the point of contact may be reduced and thus staining of the continuous medium may be further reduced.

The invention claimed is:

1. A method for forming a toner image on a continuous medium, comprising:

forming a toner image on an image support member which is rotating;

rotating a contact type transfer member, which is in a retracted position from the image support member;

conveying the continuous medium non-contactingly with the image support member between the contact type transfer member and the image support member;

bringing the contact type transfer member to the image support member so that the continuous medium is in contact with the image support member;

transferring the toner image, which is formed on the image support member, onto the continuous medium by use of the contact type transfer member while the continuous medium is in contact with the image support member; and retracting the contact type transfer member from the image support member, when a print process using the transfer process is finished.

2. The method for forming an image according to claim 1, further comprising:

feeding the continuous medium backward after the retracting step.

3. The method for forming an image according to claim 1, wherein the transferring step comprises, applying a transfer bias voltage on the contact type transfer member after that the contact type transfer member contacts with the image support member.

4. The method for forming an image according to claim 1, wherein the bringing step comprises, moving a transfer guide member and the contact type transfer member toward the image support member.

5. The method for forming an image according to claim 1, wherein in the conveying step a zigzag folded paper with perforated lines is conveyed as a continuous medium.

6. The method for forming an image according to claim 1, wherein the continuous medium is conveyed non-contactingly with both the image support member and the contact type transfer member.

7. The method for forming an image according to claim 1, wherein each side edge of the contact type transfer member is independently retracted by a corresponding one of two separate retract mechanisms.

8. The method for forming an image according to claim 1, wherein a difference in speed between the contact type transfer member and the continuous medium is in a range from −5% to +5%.

9. An apparatus for forming a toner image on a continuous medium, comprising:

a mechanism that forms a toner image on an image support member which is rotating;

a contact type transfer member that transfers the toner image, which is formed on the image support member, onto the continuous medium;

a conveyor that conveys the continuous medium non-contactingly with the image support member between the contact type transfer member and the image support member;

a rotation device that rotates the contact type transfer member;

a transfer member retract mechanism that retracts the contact type transfer member from the image support member; and a controller that causes the contact type transfer member to rotate in a retracted position from the image support member at the start of print process, and then brings the contact type transfer member to the image support member so that the continuous medium is in contact with the image support member, and transfers the toner image formed on the image support member onto the continuous medium, and causes the contact type transfer member to retract from the image support member at the end of the print process using the transfer process.

10. The apparatus for forming an image according to claim 9, wherein the controller controls the conveyor to feed the continuous medium backward when the contact type transfer member is retracted.

11. The apparatus for forming an image according to claim 9, wherein the controller applies the transfer bias voltage on the contact type transfer member after the contact type transfer member contacts with the image support member.

12. The apparatus for forming an image according to claim 9, further comprising a transfer guide retract mechanism that retracts a transfer guide member, wherein the controller controls both the transfer guide member retract mechanism and the transfer member retract mechanism to move the transfer guide member and the contact type transfer member toward the image support member respectively, so that both the transfer guide member and the contact type transfer member contact with the image support member.

13. The apparatus for forming an image according to claim 9, wherein the conveyor conveys a zigzag folded paper with perforated lines as a continuous medium.

14. The apparatus for forming an image according to claim 13, wherein the conveyor comprises a tractor feed mechanism that conveys the zigzag folded paper using the tractor wheel engaging with sprocket holes of the zigzag folded paper.

15. The apparatus for forming an image according to claim 14, wherein two of the tractor feed mechanisms are disposed at both ends of the contact type transfer member.

16. The apparatus for forming an image according to claim 9, wherein the contact type transfer member is a transfer roller.

17. The apparatus for forming an image according to claim 9, wherein the controller causes, at the start of print process, the image support member to rotate, causes a toner image to be formed on the image support member, as long as starts the conveyor to convey the continuous medium; and causes the contact type transfer member to rotate; and then brings the contact type transfer member into contact with the image support member via the continuous medium.

18. The apparatus according to claim 9, further comprising:

a transfer guide member that supports the continuous medium in the proximity of the contact type transfer member, wherein the continuous medium does not contact at least one of the contact type transfer member and the image support member.

19. The apparatus according to claim 9, further comprising:

two transfer guide members that support the continuous medium in the proximity of the contact type transfer member, wherein the continuous medium does not contact at least one of the contact type transfer member and the image support member, and wherein the controller causes the continuous medium to be in contact with the image support member by moving the contact type transfer member into contact with the continuous medium, between the two transfer guide members, toward the image support member.

20. The apparatus for forming an image according to claim 9, wherein the continuous medium is conveyed non-contactingly with both the image support member and the contact type transfer member.

21. The apparatus for forming an image according to claim 9, wherein the transfer member retract mechanism includes two separate retract devices, wherein each one of said retract devices independently retracts a corresponding separate side edge of the contact type transfer member.

22. The apparatus for forming an image according to claim 9, wherein a difference in speed between the contact type transfer member and the continuous medium is in a range from −5% to +5%.

* * * * *